US011987432B2

(12) United States Patent
Alpert

(10) Patent No.: US 11,987,432 B2
(45) Date of Patent: May 21, 2024

(54) DEVICE FOR CONTAINING A LIQUID OR SEMI-LIQUID COSMETIC OR PHARMACEUTICAL PRODUCT

(71) Applicant: IIAA Limited, Borehamwood (GB)

(72) Inventor: Joseph Alpert, Borehamwood (GB)

(73) Assignee: IIAA Limited, Borehamwood (GB)

( * ) Notice: Subject to any disclaimer, the term of this patent is extended or adjusted under 35 U.S.C. 154(b) by 52 days.

(21) Appl. No.: 18/008,350

(22) PCT Filed: Jun. 7, 2021

(86) PCT No.: PCT/GB2021/051410

§ 371 (c)(1),
(2) Date: Dec. 5, 2022

(87) PCT Pub. No.: WO2021/245430

PCT Pub. Date: Dec. 9, 2021

(65) Prior Publication Data

US 2023/0211934 A1 Jul. 6, 2023

(30) Foreign Application Priority Data

Jun. 5, 2020 (GB) ..... 2008502

(51) Int. Cl.
*B65D 65/46* (2006.01)
*B65D 25/16* (2006.01)
(Continued)

(52) U.S. Cl.
CPC ..... *B65D 65/466* (2013.01); *B65D 25/16* (2013.01); *B65D 25/48* (2013.01); *B65D 53/02* (2013.01); *B65D 2209/00* (2013.01)

(58) Field of Classification Search
CPC ..... B65D 65/466; B65D 65/46; B65D 25/16; B65D 25/14; B65D 25/48; B65D 25/40; B65D 25/38
See application file for complete search history.

(56) References Cited

U.S. PATENT DOCUMENTS 3,420,413 A 1/1969 Corsette
3,662,926 A 5/1972 Umstead
(Continued)

FOREIGN PATENT DOCUMENTS

DE 9211396 U1 12/1992
DE 202006002873 U1 5/2006
(Continued)

*Primary Examiner* — Javier A Pagan
(74) *Attorney, Agent, or Firm* — Thomas | Horstemeyer, LLP

(57) ABSTRACT

The invention provides a device (900) for containing a liquid or semi-liquid cosmetic or pharmaceutical product, the device comprising: a closure (902) comprising a product withdrawing conduit; a rigid container (901) having a first means for engaging with the closure, thereby closing the container; and a cartridge (905) enclosed within the rigid container, the cartridge having a second means for engaging with the closure, thereby forming a substantially airtight seal between the cartridge and the closure; wherein the cartridge comprises a biodegradable or recyclable rigid outer (906) enclosing a collapsible liner (907), the collapsible liner defining a cavity for containing the product, wherein the product withdrawing conduit extends inside the cavity. Also related methods, products and kits.

24 Claims, 24 Drawing Sheets

(51) Int. Cl.
*B65D 25/48* (2006.01)
*B65D 53/02* (2006.01)

(56) References Cited

U.S. PATENT DOCUMENTS

| | | | | |
|---|---|---|---|---|
| 4,322,020 | A | 3/1982 | Stone | |
| 5,100,027 | A | 3/1992 | Gueret | |
| 5,143,294 | A | 9/1992 | Lintvedt | |
| 5,370,272 | A | 12/1994 | Gueret | |
| 5,875,936 | A * | 3/1999 | Turbett | B05B 11/0094 222/536 |
| 2010/0218782 | A1 | 9/2010 | Breese et al. | |
| 2010/0276447 | A1 | 11/2010 | Patrini et al. | |
| 2011/0108516 | A1 | 5/2011 | McFarland | |
| 2013/0284760 | A1 * | 10/2013 | Orr | B65D 83/0061 222/105 |
| 2015/0021331 | A1 * | 1/2015 | Hennemann | B65D 83/0055 220/495.05 |
| 2018/0289223 | A1 * | 10/2018 | Harris | A47K 5/1217 |
| 2019/0200812 | A1 | 7/2019 | Toh et al. | |
| 2019/0201925 | A1 * | 7/2019 | Toh | B05B 11/0054 |

FOREIGN PATENT DOCUMENTS

| | | | |
|---|---|---|---|
| EP | 1556289 | A2 | 7/2005 |
| EP | 2251094 | A1 | 11/2010 |
| EP | 2345523 | A1 | 7/2011 |
| WO | 2004/054721 | A1 | 7/2004 |
| WO | 2008/135714 | A1 | 11/2008 |
| WO | 2009/047021 | A1 | 4/2009 |
| WO | 2015/005896 | A1 | 1/2015 |

* cited by examiner

DEVICE FOR CONTAINING A LIQUID OR SEMI-LIQUID COSMETIC OR PHARMACEUTICAL PRODUCT

CROSS-REFERENCE TO RELATED APPLICATIONS

This application is the 35 U.S.C. § 371 national stage application of PCT Application No. PCT/GB2021/051410, filed Jun. 7, 2021, where the PCT claims priority to, and the benefit of, United Kingdom application entitled "Environmentally sustainable product dispenser" having serial no. 2008502.3, filed Jun. 5, 2020, both of which are herein incorporated by reference in their entireties.

FIELD OF THE INVENTION

The present invention concerns devices for containing a liquid or semi-liquid cosmetic or pharmaceutical product. More particularly, but not exclusively, the invention concerns a device having a replaceable cartridge. The cartridge has features which contribute to a number of desirable goals, including: protection of the product against premature degradation; a positive user experience; reusability of the device; and ease of separation, recyclability or compostability of all or a major proportion of the cartridge. The invention also concerns related methods, including methods of making and using said devices.

BACKGROUND OF THE INVENTION

Cosmetic or pharmaceutical products such as gels, creams and liquids are widely supplied in devices having pump dispensers, because such devices provide a positive user experience by conveniently dispensing a portion of product for use. Typically, such pump dispenser devices are disposable and designed to be used only once. This has environmental drawbacks, due to the increased resource consumption inherent in a disposable product. It may be possible for a typical pump dispenser to be recycled or (in some cases, even more preferably) composted. However, the material may be contaminated with product, making this difficult, or at the very least messy and/or inconvenient, for the user. Studies have shown that while most consumers are willing to recycle or compost packaging, this willingness decreases sharply if such recycling entails bothersome, inconvenient or unpleasant processes. Furthermore, the pump part of a pump dispenser device typically includes a mixture of materials—both plastics and metals—necessitated by the complex construction of the pump, making recycling or compostability of that part very difficult. Because the different materials in a pump do not easily come apart, pumps are seldom recycled and typically end up in landfill. Yet further, a disposable device having a pump dispenser is typically limited as to how much can be spent on the pump, meaning that there is limited scope for it to be made in a way which is durable, weighty, attractive, and appealing to the consumer as a high end product. Even a relatively inexpensive disposable pump may have a significant cost associated which increases the price of the product.

As well as pump dispenser devices desirably fulfilling environmental aims (such as meeting recyclability or biodegradability and particularly compostability standards) and meeting consumer requirements, the cosmetic or pharmaceutical product itself may impose constraints on the device. For many products, the device is required to protect the product from degradation, for example by shielding it from light and/or atmospheric oxygen and/or atmospheric moisture. It is also important that materials of the device which come into contact with the product should be compatible with the product (meaning that the materials are not degraded by the product and also that the materials do not contaminate or otherwise taint the product). It would be desirable for a pump dispenser device to comprise or even consist of biodegradable (e.g., compostable) materials. However, biodegradable (e.g., compostable) materials may not typically be compatible with many products.

There is therefore a need for pump dispenser devices balancing environmental aims, for example devices meeting recyclability or biodegradability (particularly compostability) standards, with product compatibility requirements.

The present invention aims to address one or more of the problems described above. More particularly, the present invention aims to provide a device having replaceable cartridges, wherein the device is reusable (and thus environmentally friendly) while, at the same time, replacement of the cartridges is a convenient, quick and non-messy experience for the user. The present invention also aims to provide a device wherein contact between the product and the atmosphere (or other source of oxidant) is minimised. The present invention additionally aims to provide an environmentally friendly device that strikes a balance between the need for a positive environmental impact (for example, by meeting recyclability or biodegradability standards, particularly compostability standards) and the need for materials of the device which come into contact with a product to be compatible with that product.

SUMMARY OF THE INVENTION

Device

According to a first aspect, the present invention provides a device for containing a liquid or semi-liquid cosmetic or pharmaceutical product, the device comprising: a closure comprising a product withdrawing conduit; a rigid container having a first means for engaging with the closure, thereby closing the container; and a cartridge enclosed within the rigid container, the cartridge having a second means for engaging with the closure, thereby forming a substantially airtight seal between the cartridge and the closure; wherein the cartridge comprises a biodegradable or recyclable rigid outer enclosing a collapsible liner, the collapsible liner defining a cavity for containing the product, wherein the product withdrawing conduit extends inside the cavity.

In some embodiments, the first means for engaging with the closure comprises one or more detents, or a screw thread, or a bayonet fitting, or a snap-fit arrangement, a friction fit or a magnetic fastener. In some embodiments, the second means for engaging with the closure is provided on or as part of the collapsible liner. In some embodiments, the second means for engaging with the closure comprises one or more detents, or a screw thread, or a bayonet fitting, or a snap-fit arrangement, a friction fit or a magnetic fastener. For example, the collapsible liner may comprise an open-necked portion (permitting withdrawal of product from the cavity defined by the collapsible liner) provided with a means for engaging with the closure. For example, such an open-necked portion may comprise one or more detents, or a screw thread, or a bayonet fitting, or a snap-fit arrangement, a friction fit or a magnetic fastener.

In some embodiments, the cartridge is configured to restrict undesirable movement (for example rotation) of the collapsible liner relative to the rigid outer when the rigid container is engaged with and/or disengaged from the closure, but to nonetheless permit the liner and outer to be deliberately, and preferably easily and conveniently, decoupled from each other by a user, for separate disposal. In such embodiments, the liner and outer may be configured to move (for example, rotate) together when a user removes the cartridge from the closure (for example when a user unscrews the cartridge from the closure, in embodiments where the cartridge engages with the closure by means of a screw thread, such as a screw thread on an open-necked portion of the liner, or where a user twists the cartridge to disengage a bayonet fitting between the closure and an open-necked portion of the liner). The cartridge may preferably be configured so as to prevent the liner and outer from accidentally separating. Additionally, the cartridge may preferably be configured to prevent a liner having an open-necked portion configured to engage with the closure, from collapsing inwards into the lumen of the outer so as to become less accessible for engagement with the closure. However, as described herein the cartridge is configured so that a user may still deliberately decouple the collapsible liner from the rigid outer, for example by pulling the liner out of and away from the outer in a linear motion. In this way, when a liner that was previously full of product has been emptied, or almost emptied, of product, and is collapsed, the user may separate the cartridge (comprising both the liner and the outer) from the closure as one single piece, before pulling the collapsible liner of the cartridge out of the rigid outer of the cartridge if desired, for separate disposal. It will be appreciated that (once all or almost all of the product has been evacuated from the liner) a limp, crumpled used liner, taken alone, would be difficult to grip and remove from the device, for replacement by a fresh, product-filled liner. It will also be appreciated that a crumpled collapsible liner is not aesthetically pleasing to the user, which is particularly relevant in the case of a premium or high-end consumer product. It is therefore advantageous for the liner and outer to be configured so as to move (for example rotate) together, so that both may be removed from the device together, and the user does not need to grip and remove a limp, crumpled used liner, which may be messy if there is residual product in the liner. The provision of a rigid outer may optionally provide other benefits. For example, it may optionally be opaque and/or light excluding in order to prevent light sensitive ingredients of the product from being harmed (for example to prevent the loss of vitamin A activity). A rigid outer may additionally allow the collapsible liner to be made thinner because it protects the collapsible liner from puncture and/or from busting during filling.

Annular Collar

To restrict undesirable movement (for example rotation) of the collapsible liner relative to the rigid outer, the liner may comprise an annular collar that is configured to engage with a complementary annular section of the outer. The annular collar may comprise protrusions that are configured to engage with complementary recesses comprised in the annular section of the outer. Alternatively, the collar may comprise recesses, and complementary protrusions may be comprised in the annular section of the outer which may be configured to engage with the recesses of the collar. In some embodiments, the collar may comprise a combination of protrusions and recesses, and the annular section of the outer may comprise a combination of complementary protrusions and recesses. When the means for the cartridge engaging with the closure is provided on or as part of the collapsible liner (e.g., a screw thread provided on an open-necked portion of the liner) the annular collar of the liner may be positioned between the main (collapsible) body of the liner and that means (e.g., a screw thread provided on an open-necked portion of the liner).

Further Component for Holding Together the Outer and the Liner

In some embodiments, the cartridge also comprises one or more further components for holding together the outer and the liner. In some embodiments, these one or more further components may be provided in addition to the annular collar. The further components may comprise, for example, a ring, a clip or a snap-off fastener. In certain preferred embodiments, the further components consist of a ring, such as a screw-down ring, that engages with the rigid outer, for example by means of complementary screw threads, and is configured to hold together the collapsible liner and the rigid outer, optionally maintaining engagement by means of complementary recesses and protrusions comprised by the outer and liner. This further restricts undesirable movement (for example rotation) of the liner relative to the outer when the rigid container is engaged with and/or disengaged from the closure, but the liner and outer may still be deliberately decoupled from each other by a user for separate disposal, for example by means of removal or disengagement of the one or more further components. In certain preferred embodiments, the further component is a screw-down ring that engages with the outer by means of a screw thread. It will be appreciated that the optional further component(s), such as a screw-down ring, may be configured so as to co-operate with the annular collar of the liner to secure the liner to the outer and prevent relative movement (for example rotation) between the liner and the outer. The optional further component(s), e.g. screw-down ring, may also be configured to restrict an open-necked portion of the collapsible liner from collapsing inwards, i.e., becoming difficult to access for engagement with the closure, inside the rigid outer.

Biodegradable or Recyclable Rigid Outer

In some embodiments, the rigid outer of the cartridge of the invention is recyclable. Thus, in some embodiments the rigid outer may comprise or consist of a recyclable plastics material. It may, in some embodiments comprise or consist of a polyester plastics material. It may, in some embodiments comprise or consist of a polyolefin plastics material. For example, the rigid outer may be recyclable and comprise one or more of: high density polyethylene (HDPE); polyethylene terephthalate (PET); polyethylenefuranoate (PEF); polytrimethylene furanicarboxylate (PTF); and polypropylene (PP). In some embodiments, the rigid outer is recyclable and comprises glass. In some embodiments, the rigid outer is recyclable and comprises a recyclable metal material, such as one or more of aluminium and steel.

In some embodiments, the rigid outer of the cartridge of the invention is biodegradable. Thus, in some embodiments, the rigid outer may comprise or consist of a biodegradable plastics material. For example, the rigid outer may be biodegradable and comprise one or more of: polylactic acid (PLA), polyhydroxyalkanoate (PHA), a starch-based polymer, a cellulose-based polymer, and a lignin-based polymer. In certain preferred embodiments, the rigid outer is biodegradable and comprises polylactic acid. In some embodiments, the rigid outer is biodegradable and is made out of a wood material (for example natural wood, such as bamboo or cork, or engineered wood) or a material comprising fibres or particles of wood, or other plant material embedded in a biodegradable resin. In some embodiments, the rigid outer is biodegradable and comprises a biodegradable fibre-reinforced thermoplastic composite material, for example a biodegradable plant fibre-reinforced thermoplastic composite material, such as a biodegradable plant fibre-reinforced thermoplastic composite material comprising one or more of PLA and PHA.

Advantageously (and particularly in embodiments wherein the rigid outer is biodegradable) the cartridge is configured so that the rigid outer may be separated from the collapsible liner by a user, enabling separate disposal of each. In use, the cartridge may be configured so that the cavity of the collapsible liner holds the product, and the rigid outer does not come into contact with the product.

When the outer does not come into contact with the product, the outer may be made from a material or materials that are not restricted by compatibility with the product. Particularly, in some embodiments, the outer may be made from eco-friendly, biodegradable material or materials, such as biodegradable materials disclosed hereinabove, which are not restricted by compatibility with the product.

In some embodiments, the outer may form a major proportion of the total material of the cartridge, while the collapsible liner may form a much smaller proportion of the total material of the cartridge. For example, the outer may comprise at least 70, at least 80, or at least 90% by weight of the total material of the cartridge. In certain preferred embodiments, the material of the rigid outer comprises at least 95% by weight of the total material of the cartridge, for example at least 96%, at least 97%, at least 98%, or at least 99% by weight of the total material of the cartridge.

After use, when all product has been evacuated, the rigid outer and collapsible liner may in some embodiments be decoupled by a user, for separate disposal (particularly in embodiments wherein the rigid outer is biodegradable).

In embodiments wherein the rigid outer is biodegradable, the outer, forming a major proportion of the cartridge, may optionally be composted.

A minor proportion of the cartridge, namely the collapsible liner, may in some embodiments be recycled or otherwise disposed of, for example as household waste. In some embodiments, the collapsible liner may be biodegradable; for example, it may be compostable and may therefore be composted.

It will be appreciated that the material of the collapsible liner may be selected based on its compatibility with the product it contains in use. In some embodiments, the rigid outer and the collapsible liner are advantageously made of different materials to each other.

In the composting industry, it is preferable that within six months of an item being placed under composting conditions (for example, being placed under certain conditions of moisture and/or temperature) at least 90% of the item will have been composted. It may be acceptable for the remaining up to 10% of the item to be composted more slowly, or be essentially non-compostable (and preferably having no negative effect on the composting process). Therefore, in embodiments wherein the rigid outer is biodegradable, the collapsible liner may be formed of a material which is slower to degrade than the biodegradable material of the rigid outer, where the collapsible liner comprises less than 10%, for example less than 5% by weight of the total material of the cartridge, and thus, preferably, has no negative effect on the composting process. The collapsible liner may comprise a material that is compatible with the product it contains in use, for example polyethylene terephthalate (PET); or a related polyester polymer such as polyethylene-furanoate (PEF) or polytrimethylene furanicarboxylate (PTF); or polypropylene (PP). The collapsible liner may optionally comprise or consist of a material that is recyclable. The collapsible liner may, in some embodiments, be formed of a biodegradable material that is compatible with the product it contains in use, but which, in embodiments wherein the rigid outer is biodegradable, optionally degrades more slowly than the biodegradable material of the rigid outer. In embodiments wherein the rigid outer is biodegradable, it may be formed from a readily compostable material, for example a material that degrades completely under composting conditions (for example, a temperature in the range of from 30 to 60° C. and a moisture content of from 40 to 60% w/w) within 12 months, 10 months or 8 months, more preferably within 6 months.

The outer of the cartridge is rigid. As used herein, the term 'rigid' means that the structure in question is substantially inflexible, and thus will essentially not bend, flex or fold under an applied force, for example an applied force of the kind to which it will be subjected during ordinary handling. It will be appreciated that the rigid outer may therefore protect the collapsible liner, and support it structurally. For this reason, the walls of the main body of the collapsible liner may be made very thin, and the amount of material used to form the collapsible liner minimised. As described herein, the outer may form at least 70, at least 80, at least 90, preferably at least 95, for example at least 96, at least 97, at least 98, or at least 99% by weight of the total material of the cartridge. Thus, the collapsible liner may form less than 30, less than 20, less than 10, preferably less than 5, for example less than 4, less than 3, less than 2, or less than 1% by weight of the total material of the cartridge. Advantageously, this minimises the amount of material used to manufacture the collapsible liner. Reducing the amount of material in this way may be a more effective way of meeting environmental aims (for example, reducing carbon footprint or energy use during manufacture) than, for example, changing the material used in manufacture of the collapsible liner.

Collapsible Liner

The collapsible liner defines a cavity for containing the product. As used herein, the term 'collapsible' means that the structure in question is configured to collapse (such as by deflating or flattening) so as to occupy a smaller volume of space. In some embodiments, the collapsible liner is attached to the rigid outer at one end only, for example at an open end through which product may be withdrawn, for example through an optional open-necked portion of the liner, so that the collapsible liner may collapse away from the side walls of the rigid outer as product is evacuated from the liner. In certain embodiments, the collapsible liner takes the form of a bag which is able to collapse by flattening; in others, it may take the form of a deflatable bag. It will be understood that, in use, product contained within the cavity of the collapsible liner will need to be withdrawn from the collapsible liner by the product withdrawing conduit. One way of achieving this is to provide the collapsible liner with an opening through which the product withdrawing conduit may pass. In embodiments having such a configuration, the opening of the collapsible liner and an opening of the rigid outer will preferably be aligned so that a product withdrawing conduit is able to pass though both openings. In other embodiments, it may be possible to provide the collapsible liner without an opening. The product withdrawing conduit would then need to puncture a wall of the collapsible liner to withdraw the product from within the cavity.

In some embodiments, the collapsible liner is manufactured by a method comprising blow molding, such as extrusion blow molding or injection blow molding. Preferably, it is manufactured by a method comprising injection blow molding. Excess material may be trimmed from the collapsible liner if desired, for example by spin trimming. Injection molding, such as injection blow molding, is a cost-effective and low-energy means by which to form the collapsible liner.

As described herein, the walls of the collapsible liner may be made from any material which is compatible with the product. In certain embodiments the walls of the collapsible liner are made from a recyclable material, for example polyethylene, such as HDPE or LDPE or a mixture comprising both HDPE and LDPE. The walls of the collapsible liner may be formed from a polymeric film material, such as a film comprising polyethylene, for example one or more of HDPE and LDPE. In some embodiments, the walls of the collapsible liner may be made of a compostable material, such as a biodegradable plastics material. For example, the walls of the collapsible liner may comprise one or more of: polylactic acid (PLA), polyhydroxyalkanoate (PHA), a starch-based polymer, a cellulose based polymer, and a lignin-based polymer. In certain preferred embodiments, the walls of the collapsible liner comprise or consist of a polyester, such as a thermoplastic polyester resin. Preferably, the polyester is recyclable. Of the polyesters, polyethylene terephthalate (PET) is particularly preferred. PET is widely available, typically at low cost. The PET may comprise, or consist of bio-PET, meaning that it is produced from renewable biomass sources (e.g., vegetable fats/oils; straw; woodchips; sawdust; and/or recycled food waste). The PET may be derived by recycling of used plastic waste (e.g., recycled plastic containers). The mechanical and chemical properties of PET mean that it is particularly suitable for use in injection blow moulding processes to form the collapsible liner of the invention. PET may be injection blow moulded to form a collapsible liner having walls with portions of varying thicknesses. Advantageously, the mechanical properties of PET mean that it may be injection blow molded into a liner with walls having very thin portions (for example, portions having a wall thickness of up to 1 mm, up to 0.9 mm, up to 0.8 mm, up to 0.7 mm, up to 0.6 mm, up to 0.5 mm, up to 0.4 mm, up to 0.35 mm, up to 0.3 mm, or up to 0.25 mm) that nonetheless retain their strength. As an alternative to PET, polyethylenefuranoate (PEF) or polytrimethylene furanicarboxylate (PTF) may be used. In some embodiments, polypropylene (PP) may be used. In some embodiments, a mixture of two or more of PET, PEF, PTF and PP may be used. It will be appreciated that the chemical and mechanical properties of PEF, PTF and PP mean that these materials, like PET, are particularly suited to injection blow moulding to form the collapsible liner.

In certain preferred embodiments, the main body of the liner may have very thin walls, while at the same time the liner may also include thicker wall portions (for example, thicker wall portions at and/or towards the neck of the liner, such as at and/or towards an open-necked portion suitable for withdrawal of product and/or for engagement with the closure). In certain preferred embodiments, as described herein, the liner comprises an annular collar (shaped to engage with a complementary annular section of the rigid outer) and the thickness of the material forming the annular collar is greater than the wall thickness of the material of the main body of the liner. In certain preferred embodiments, the liner comprises the means by which the cartridge engages with the closure (e.g., a screw thread) the material of which may have a greater thickness than the wall thickness of the material of the main body of the liner.

By having a very thin-walled main body, the liner may collapse easily as product is withdrawn, without air entering into the cavity of the liner, thereby better preserving a product within the cavity of the liner, particularly where the product is an oxygen-sensitive product. Typically in the consumer beverage industry, plastic (such as PET, PEF, PTF or PP) bottles are made with thick enough walls to prevent the bottle collapsing inwards when it is emptied and to maintain sufficient structural strength and shape to allow reasonably easy pouring of a beverage. In contrast, the main body of the collapsible liner of the present invention may be deliberately configured to collapse as a product is dispensed, rather than maintaining its shape. This collapsing action avoids the need for air to come into contact with the product. At the same time, structural features of the cartridge mitigate the collapse of the liner, and undesirable consequences thereof. In particular, the rigid outer supports and contains the liner. In some preferred embodiments, an annular collar on the liner, as described herein, may engage with a complementary annular section of the rigid outer, thereby providing support for the collapsible liner and holding it in place, even when it collapses as product is withdrawn. Similarly, an optional further component or components of the cartridge (e.g. a ring, such as a screw-down ring) as described herein may engage with the rigid outer and may help to hold together the collapsible liner and the rigid outer.

Thus, some or all of the material of the walls of the collapsible liner, particularly the material of the walls of the main body of the liner, may in certain preferred embodiments be very thin. This is especially preferred when the liner comprises or consists of PET, PEF PTF, PP, or a mixture of two or more of these. In some embodiments, the material of the main body of the collapsible liner has a wall thickness of up to 1 mm, up to 0.9 mm, up to 0.8 mm, up to 0.7 mm, up to 0.6 mm, up to 0.5 mm, up to 0.4 mm, up to 0.35 mm, up to 0.3 mm, or up to 0.25 mm. In some embodiments, the material of the main body of the collapsible liner has a wall thickness of 0.2 mm.

By providing the collapsible liner (for example, a collapsible liner comprising or consisting of PET, PEF, PTF and/or PP) with a very thin-walled main body, the amount of material used to form the liner is minimised. In this case, in embodiments wherein the rigid outer is biodegradable, it may be possible to dispose of the rigid outer and the collapsible liner together by composting, even if the collapsible liner is not made of a biodegradable material. As described herein, in the composting industry, it is preferable that within six months of an item being placed under composting conditions (for example, being placed under certain conditions of moisture and/or temperature) at least 90% of the item will have been composted. If the material of the walls of the main body of the collapsible liner is very thin, then the collapsible liner may optionally form less than 10% by weight (preferably less than 5, for example less than 4, less than 3, less than 2, or less than 1% by weight) of the total material of the cartridge and may thus, preferably, have no negative effect on a composting process. In this case, the collapsible liner and rigid outer may be disposed of by composting together without unacceptably compromising the composting process or the compost formed.

When the main body of the collapsible liner is very thin-walled, it will be floppy, unwieldy and, when filled or in the presence of residual product, potentially messy for a user to manipulate, taken alone. It is therefore advantageous for the cartridge to comprise the rigid outer, which provides structural support to the collapsible liner and which is easier for the user to grip and manipulate. When the cartridge is configured to restrict undesirable rotation of the liner relative to the outer, the liner and outer will rotate together, for example when a user removes the cartridge from the closure by applying a rotary or twisting force by hand to the outer surface of the cartridge, providing a simpler user experience. The presence of the supportive rigid outer may also make it easier for the liner to be filled with a product, e.g. in the factory.

Biodegradable Material

In some embodiments, the rigid outer of the invention is biodegradable. In certain preferred embodiments, the biodegradable material of the rigid outer may be compostable. In certain preferred embodiments, the collapsible liner also comprises or consists of biodegradable material, which may in some embodiments also be compostable.

In general, the environmental profile of a packaging material may be optimised by the use of material which may either be biodegradable or recyclable. The present invention contemplates both routes to improved sustainability. However, biodegradability may be especially attractive when the cartridge of the invention is used to contain a cosmetic product. This is because the residues remaining in containers which previously held cosmetic products are often mixtures of chemicals which are essentially biodegradable themselves, but which might contaminate a recycling stream. For example, plant-derived lipids in cosmetic products might contaminate a recycling stream (although this is not an insurmountable problem because materials processing can include washing out of residue prior to recycling) but will nonetheless biodegrade (including, in some embodiments, compost) successfully. Furthermore, biodegrading, particularly by composting, may be better able to cope with mixtures of materials than recycling. In some embodiments of the invention, the rigid outer is biodegradable, and the rigid biodegradable outer and the collapsible liner consist of or comprise the same biodegradable materials, which may be composted together. In alternative embodiments, they consist of or comprise different materials, for example different biodegradable materials, which may nonetheless be composted together.

Rigid Container

The cartridge of the invention is enclosed within the rigid container of the invention. The rigid container thus encloses the rigid outer of the cartridge. In this way, the rigid container protects the rigid outer from moisture in the atmosphere, which may be particularly advantageous when the rigid outer is biodegradable. For example, the device of the invention may conveniently be stored in a user's bathroom, which typically has a moist atmosphere. The rigid container thus provides a barrier between the rigid outer and atmospheric moisture, thereby preventing the rigid outer, when biodegradable, from degrading while product remains in the liner and the cartridge is in use.

The rigid container may comprise any suitable material(s). It is preferred that the rigid container comprises one or more relatively durable materials, because it is reusable and intended to be used with multiple disposable cartridges. The rigid container also serves to hide the cartridge from the user, and it may be desirable for the rigid container to appear attractive to the user. For example, the rigid container may be provided in a range of colours and/or finishes, in order to provide for the user a choice of colours and/or finishes to complement the decor of a room in which the device is to be located, or which are otherwise aesthetically appealing to the user. Providing rigid containers in a range of colours also allows the rigid containers to be colour coded so if the user acquires more than one rigid container for the dispensing of different products, they will be able to easily select the correct product. In some embodiments, the colour will be selected according to the wishes and tastes of the user. In some embodiments, the colour may be selected by the manufacturer. For example, it may be selected to correspond to colour coding applied to the cartridges of the invention.

In some embodiments, the rigid container preferably comprises aluminium, or an alloy thereof. Such a material may advantageously be durable, lightweight and attractive in appearance. The rigid container may be surface treated, for example by brushing or anodising, or to add colour. Other materials for the rigid container that may be used in accordance with various embodiments of the invention include plastics (for example, recycled material recovered from the recycling of cartridges), ceramics (for example a fired clay material, and further metals, such as copper, brass, or steel (especially stainless steel). Other materials for the rigid container include fibre-reinforced thermoplastic composite materials, for example non-biodegradable fibre-reinforced thermoplastic composite materials. Such a composite material may in some embodiments comprise, as thermoplastic material, one or more of: polypropylene (PP), acrylonitrile butadiene styrene (ABS); polystyrene (PS); and polyoxymethylene (POM). The composite material may comprise, as fibres, natural fibres such as wood or other plant fibres. For example, the rigid container may comprise or consist of (optionally, non-biodegradable) coniferous timber fibres in a thermoplastic. An example of suitable material is the Kareline® range of materials available from Plasthill Oy, Finland.

Substantially Airtight Seal

The cartridge of the invention has a means for engaging with the closure, thereby forming a substantially airtight seal between the cartridge and the closure. In some preferred embodiments, this means for engaging with the closure is provided on or as part of the collapsible liner. On other embodiments, the means for engaging with the closure is provided as part of the rigid outer. On embodiments wherein the cartridge comprises a screw-down ring (as described elsewhere herein) the means for engaging with the closure may optionally be provided as part of the screw-down ring. The means for engaging with the closure may optionally comprise one or more detents, or a screw thread, or a bayonet fitting or snap-fit arrangement, or a friction fit, or a magnetic fastener. For example, the collapsible liner (or the rigid outer) may comprise an open-necked portion (permitting withdrawal of product from the cavity defined by the collapsible liner) provided with a means for engaging with the closure. For example, such an open-necked portion may comprise one or more detents, or a screw thread, or a bayonet fitting, or a snap-fit arrangement, or a friction fit arrangement, or a magnetic fastener.

An advantage of providing a substantially airtight seal thus is to minimise contact between a product in the cavity of the liner, particularly an oxygen-sensitive product, such as a cosmetic or pharmaceutical product having one or more oxygen-sensitive active ingredients, and atmospheric oxygen.

In some embodiments, an elastomeric ring gasket is provided between the cartridge and the closure, thereby increasing the substantially airtight seal.

In some embodiments, the elastomeric ring gasket is disposed on the cartridge (for example, on the collapsible liner or the rigid outer). Advantageously, when the elastomeric ring gasket is disposed on the cartridge, the gasket may be made cheaply, since it will be replaced when the cartridge is replaced.

In some embodiments, the elastomeric ring gasket is disposed on the closure. In such embodiments, a greater investment in the gasket may be required, since the closure is not intended for disposal, unlike the cartridge. However, an advantage of this configuration is that only one gasket needs to be provided per device (rather than a plurality of gaskets for a succession of disposable cartridges). Additionally, if a gasket is not disposed on the cartridge, this simplifies the cartridge construction and means the cartridge may be made more cheaply. It may also result in a cartridge which is more easily recyclable and/or more easily compostable because the number of different materials used in its construction is reduced.

In some embodiments, one or more small pressure-compensating apertures may be provided through the rigid container. For example, the total area of the pressure-compensating apertures may be not more than 1%, not more than 0.5%, or not more than 0.1% of the total surface area of the rigid container. In such embodiments, one or more small pressure-compensating apertures may also be provided through the material of the rigid outer. For example the total area of the pressure-compensating apertures may be not more than 1%, not more than 0.5%, or not more than 0.1% of the total surface area of the rigid outer. It will be appreciated that small pressure-compensating apertures may assist with pressure equalisation within the enclosed spaces of the device when the device is in use, for example while product is being evacuated from within the collapsible liner. At the same time, apertures having such a small area do not significantly inhibit the protective function of the rigid container, which still provides a sufficient barrier between the rigid outer and moisture in the surrounding atmosphere, which may be particularly advantageous in embodiments wherein the rigid outer is biodegradable.

Product Withdrawing Conduit

In some embodiments, the product withdrawing conduit extends into the cavity defined by the collapsible liner by no more than 25% (for example, by no more than 20%, no more than 15%, or no more than 10%) of the longest dimension of the collapsible liner. It is not necessary for the conduit to extend the full length of the cavity, and by keeping it rather short relative to the cavity, the risk of the conduit or the collapsible liner being damaged is reduced. This may also reduce wastage caused by product clinging to the external surface of the conduit.

In other embodiments, the product withdrawing conduit extends into the cavity defined by the collapsible liner by more than 50% (for example, by more than 60%, more than 65%, more than 70%, or more than 75%) of the longest dimension of the collapsible liner. Such product withdrawing conduits may be particularly easy to manufacture, and/or may be particularly readily available.

In some embodiments, the product withdrawing conduit comprises a substantially cylindrical portion and a spiked portion, wherein the spiked portion may be substantially conical and suitable for piecing a foil or a film. For example, the spiked portion may be suitable for piercing a sealing foil used to seal a full cartridge. An advantage of this is that the sealing foil is pierced only when the spiked portion comes into contact with it when the cartridge is inserted in the device and has been sealed to or very soon will be sealed to the closure, and does not need to be pierced by a user before the cartridge is inserted into the device. This minimises contact between a product contained in the cavity of the liner and atmospheric oxygen. A spiked portion that is substantially conical in shape may have its internal bore opening to the side as opposed to the apex of the cone, so that the risks of foil blocking the bore are minimised.

The product withdrawing conduit may be made of any suitable material. For example it may comprise one or more plastics, or one or more metals.

Pump

In some embodiments, the closure comprises a pump. The pump may be an automatic pump or a manually operated pump, being operable to pump the product from the cavity into the product withdrawing conduit and out of the device through a product dispensing head.

Suitable automatic pumps and manually operated pumps are well known for dispensing cosmetic and other products. Manually operated pumps typically comprise a part or actuator to be depressed by hand, for example by a thumb of a user, from a first position to a second position, and a biasing means, such as a spring, for returning the part to be depressed by hand to the first position when it is no longer depressed. This draws up product into the pump unit such that when the part to be depressed by hand is depressed again, product is dispensed from the device for use by the user. Automatic pumps typically comprise a sensor, for example a motion sensor, instead of a part or actuator to be depressed by hand. The pump may be adapted to dispense a predetermined portion of product, for example enough for a particular use. Typical dispensing volumes may be within a range of from 0.5 to 200 ml. For example, a typical dispensing volume may be 1, 2, 3, 4, 5, 10, 20, 30, 50, 100, 150 or 200 ml. Various dispensing heads may be used, depending on the requirements and intended use of the product. For example, a dispensing head may optionally be configured to encourage foaming of the product. If a product is of low viscosity, the dispensing head may optionally be configured to dispense the product as a mist. For many cream or gel products, the dispensing head may be arranged to dispense the product as a conveniently-sized portion, for example, into the hand of the user.

The pump may be made of any suitable material or materials. Such pumps (whether manual or automatic) are available ready-assembled from a range of manufacturers. The outer surface of the pump may be visible in use, and so may be made of a material and in a colour to provide a suitably attractive appearance to the user. For example, it may be made of the same material as the rigid container, or may have the same or a complementary colour as that of the rigid container.

Optionally, the device further comprises a lid configured to cover the pump so as to improve its appearance and/or to protect the pump from damage or accidental actuation, for example when the device is in transit.

Sealing of Cartridge

The opening of the cartridge may be sealed in order to prevent spillage and to keep the contents fresh. It may be sealed with a foil, for example a metal foil (for example an aluminium foil) or a plastic foil (for example, a plastic foil comprising a polyethylene film, or one comprising a polyvinyl chloride film). Optionally, the sealing film may be provided with a heat-seal resin to achieve sealing. Ideally, the foil is such that it may be pierced by a spiked or conical portion of the product withdrawing conduit of the invention; as described herein, this advantageously minimises contact between the product and air. However, alternative sealing foils such as those configured with a tab to be peeled off by hand by a user are also included within the scope of the invention.

In addition to a sealing foil, or as an alternative, the cartridge may optionally be supplied with further sealing means, such as a snap-off or screw-off lid. This may be used to protect the foil underneath from accidental damage.

Additionally or alternatively, the cartridge may be provided in an outer package such as a box, bag, or packet for convenient storage, transportation, or shipping, and to provide an attractive appearance to the user prior to use, for example in a retail environment. The outer package may provide a convenient place for a label, barcode, etc.

Method of Making the Device

According to a second aspect, the present invention provides a method of making the device of the first aspect of the invention, the method comprising: providing the closure, the rigid container, and the cartridge; and attaching each of the rigid container and the cartridge to the closure.

Where the device comprises a product, the method of making the device may further comprise filling the cavity of the collapsible liner with the product. The cartridge may optionally be assembled, with the collapsible liner enclosed in the rigid outer, before this filling step is carried out. In this case, the outer may advantageously prevent the liner (for example, a liner comprising PET, PTF, PEF and/or PP) from rupturing even under a high pressure of product entering the cavity of the liner.

Method of Disposing of the Cartridge

According to a third aspect, the present invention provides a method of disposing of the cartridge of the device of the first aspect of the invention, the method comprising decoupling the rigid outer from the collapsible liner; or disposing of the rigid outer and the collapsible liner together, without decoupling the rigid outer from the collapsible liner. Preferably, the method comprises disposing of a cartridge of the device that previously contained a product, but which has now been emptied, or almost emptied, of that product. Such a method may optionally comprise the additional or preceding steps of separating the cartridge from the closure.

It will be understood that the method of the third aspect of the invention may optionally incorporate one or more features or additional components described herein with reference to the other aspects of the invention, and particularly features of the device of the first aspect of the invention, or the operation thereof User Experience when Disposing of the Cartridge In some embodiments, the cartridge is configured to restrict undesirable movement (for example rotation) of the liner relative to the outer when the rigid container is engaged with and/or disengaged from the closure. Preferably, the liner and outer may still (deliberately) be decoupled from each other for separate disposal by a user, if desired.

When the device is used by a consumer, product contained within the collapsible liner is evacuated over time. Once all (or almost all) of the product has been evacuated from the liner, what remains is the limp, crumpled used liner. Taken alone, this used liner would be difficult to manipulate and/or grip, for example in order to remove it from the rest of a device, for replacement by a fresh, product-filled liner. It will also be appreciated that a crumpled collapsible liner is not aesthetically pleasing to the user, which is particularly relevant in the case of a premium or high-end consumer product.

Therefore, in certain preferred embodiments of the invention, the cartridge is configured so as to restrict undesirable movement (for example rotation) of the liner relative to the outer when the rigid container is engaged with and/or disengaged from the closure. However, in certain preferred embodiments, the liner and outer may be decoupled deliberately by a user, for separate disposal. The liner and outer are preferably configured to rotate together when a user removes the cartridge from the closure (for example when a user unscrews the cartridge from the closure, in embodiments where the cartridge engages with the closure by means of a screw thread or a bayonet fitting). The liner and outer will not accidentally separate. However, in preferred embodiments, a user may still deliberately decouple the liner from the outer, for example by pulling the liner out of and away from the outer in a linear motion. In this way, when a liner that was previously full of product has been emptied, or almost emptied, of product, and is collapsed, the user can remove the cartridge (comprising both the liner and the outer) from the closure as one single piece, before pulling the liner out of the outer, if desirable, for separate disposal. Advantageously, the rigid outer of the cartridge may also hide the crumpled collapsible liner from view.

In some embodiments, the liner and outer comprise engagement means. In such embodiments, the engagement means are configured to restrict undesirable movement (for example rotation) of the liner relative to the outer when the rigid container is engaged with and/or disengaged from the closure, yet the liner and outer may optionally be decoupled from each other by disengaging the engagement means, for separate disposal. In some embodiments, the engagement means comprise an annular collar comprised by the liner that is configured to engage with a complementary annular section of the outer, complementary screw threads, or a bayonet fitting, or a snap-fit arrangement, or a friction fit arrangement, or a magnetic fastener.

In particularly preferred embodiments, to restrict undesirable movement (for example rotation) of the liner relative to the outer, the liner comprises an annular collar that is configured to engage with a complementary annular section of the outer. The annular collar may comprise protrusions that are configured to engage with complementary recesses comprised in the annular section of the outer. Alternatively, the collar may comprise recesses, and complementary protrusions may be comprised in the annular section of the outer, which may be configured to engage with the recesses of the collar. In some embodiments, the collar may comprise a combination of protrusions and recesses, and the annular section of the outer may comprise a combination of complementary protrusions and recesses. When the means for the cartridge engaging with the closure is provided on or as part of the collapsible liner (e.g., a screw thread on an open-necked portion of the collapsible liner) the annular collar of the liner may be positioned between the main (collapsible) body of the liner and that means (e.g., a screw thread on an open-necked portion of the collapsible liner).

In some embodiments, the engagement between the liner and the outer relies solely on the cavity of the liner being filled with product. In this way, a liner expanded by being filled with product may fit snugly into the outer, whereas a collapsed liner does not fit so snugly and may be removed more easily.

In some embodiments, the liner and the outer are made in complementary shapes that restrict undesirable movement (for example rotation) of the liner relative to the outer when the rigid container is engaged with and/or disengaged from the closure (such as shapes each having a complementary square cross-section). However, when the walls of the main body of the liner are made of a very thin material, this may not be enough to restrict movement (for example rotation). For this reason, it is advantageous in such embodiments to provide an annular collar on the liner, as described herein, and a complementary annular section of the outer.

When the cartridge is spent (when all, or almost all, of a product has been evacuated from the cavity of the collapsible liner) the user may separate the rigid container from the cartridge, without needing to separate the collapsible liner, taken alone, from the rigid container. In this way, no mess (for example, residual product, or torn parts of the collapsible liner) comes into contact with the rigid container. The liner and the rigid outer may then optionally be decoupled by a user, for example by unscrewing them from each other, or by unlocking a bayonet fitting or by separating the annular ring of the liner from the complementary annular section of the outer, or simply by twisting them apart if they are made in complementary shapes that restrict undesirable movement (for example rotation) of the liner relative to the outer (such as shapes each having a complementary square cross-section), or by snapping a snap-fit arrangement, or by releasing a friction fit arrangement, or by unfastening a magnetic fastener. Optionally, undesirable rotation of the outer and liner relative to each other is restricted, but not linear movement of the outer and liner relative to each other—for example, the liner may in some embodiments simply be pulled out of the outer by a user.

The liner and the rigid outer may then, optionally, be separately disposed of. For example, in embodiments wherein the rigid outer is biodegradable and compostable, the rigid outer may be composted. The collapsible liner may optionally be recycled.

In some embodiments, the collapsible liner and the rigid outer engage at an opening of the rigid outer that is a relatively wide opening. For example, the opening may have an area that is at least 5, 10, 15 or 20% of the surface area of the rigid outer. In such embodiments, it may be particularly easy for the user to decouple the rigid outer from the collapsible liner, enabling separate disposal of each.

In some embodiments, methods of disposing of the cartridge are provided wherein the rigid outer is not decoupled from the collapsible liner. For example, in embodiments wherein both the rigid outer and the collapsible liner are recyclable together (such as in a single recycling stream) or wherein both are biodegradable (for example, both are compostable) both the liner and the outer may be disposed of together by recycling or biodegrading (e.g., composting) without being decoupled.

Composting a Part or all of the Cartridge

In some embodiments wherein the rigid outer is biodegradable and compostable, methods of the invention further comprise composting the rigid outer, optionally together with the collapsible liner, or in certain preferred embodiments having previously been separated from the collapsible liner.

Recycling a Part or all of the Cartridge

In some embodiments wherein the rigid outer is recyclable, methods of the invention further comprise recycling the rigid outer, optionally together with the collapsible liner, or having previously been separated from the collapsible liner (e.g., where the collapsible liner is disposed of as household waste).

Standards for Biodegradability/Compostability

The term biodegradable as used herein means that when the material in question is placed in a suitable environment (for example, an environment having a moisture content of 40 to 60% by weight, and a temperature of 30 to 60° C.) it will compost to $CO_2$, water and biomass within an acceptable period of time, for example within 12 months, 10 months or 8 months, and preferably within 6 months.

Various standards for biodegradability/compostability exist. According to certain embodiments, materials described herein as biodegradable/compostable are industrially compostable, for example complying with European standard EN 13432 (incorporated by reference herein in its entirety). According to other embodiments, material described as compostable may additionally or alternatively be compostable in a home composter, for example complying with Australian norm AS 5810 (incorporated by reference herein in its entirety). The EN 13432 standard, published as BS EN 13432 by the British Standards Institute (and incorporated by reference herein in its entirety), requires that the material meets the following criteria:

1) Disintegration

The sample is mixed with organic waste and maintained under composting conditions for 12 weeks, after which time no more than 10% of material fragments are larger than 2 mm.

2) Biodegradability

A measure of the actual (metabolic, microbial) conversion, under composting conditions, of the material into water, carbon dioxide and new cell biomass. Within a maximum of 6 months, biodegradation of the sample must generate an amount of carbon dioxide that is at least 90% of the carbon dioxide that would be released if total biodegradation were to have occurred.

3) Low Levels of Heavy Metals (Potentially Toxic Elements) and No Adverse Effect of the Quality of Compost Produced Upper limits, as values in mg/kg of dry sample, are: zinc 150, copper 50, nickel 25, cadmium 0.5, lead 50, mercury 0.5, chromium 50, molybdenum 1, selenium 0.75, arsenic 5 and fluoride 100.

4) The Composted Packaging Material Must not have Adverse Effect on the Bulk Density, 30 pH, Salinity (Electrical Conductivity), Volatile Solids, Total Nitrogen, Total Phosphorus, Total Magnesium, Total Potassium and Ammonium Nitrogen Characteristics of the Compost.

According to some embodiments of the invention, material referred to herein as biodegradable, or as compostable, meets one of more of the criteria (1) to (4) described hereinabove. For example, it may meet all of criteria (1) to (4).

Kit of Parts

According to a fourth aspect, the present invention provides a kit of parts for forming the device of the first aspect of the invention, the kit comprising the closure, the rigid container and the cartridge. It will be appreciated that the kit of parts may optionally comprise one or more features or additional components described herein with reference to the other aspects of the invention, and particularly features of the device of the first aspect of the invention. In particular embodiments, a kit of parts may include instructions for assembly of the parts or instructions for the use of the device assembled from the kit of parts.

Use of the Device

According to a fifth aspect, the present invention provides the use of the device of the first aspect of the invention for dispensing a liquid or semi-liquid cosmetic or pharmaceutical product.

The device may be used by dispensing a desired amount of a product by means of a pump, as described herein. The product may for example be used by application to the surface of the skin, or by application to the hair, in the case of a cosmetic product.

It will be appreciated that the cartridge of the invention is preferably supplied to the consumer pre-filled with product. The present invention encompasses both filled and unfilled cartridges. The consumer is conveniently able to install the cartridge within the rigid container and dispense the product. Once all or almost all of the product has been evacuated, the user may then remove the empty cartridge from the rigid container.

Product

The product is a liquid product or a semi-liquid product, such as a viscous liquid, gel or cream.

In preferred embodiments, the product is a cosmetic product such as a toothpaste, skin treatment cream, a soap, shampoo, conditioner, or other hair or skin treatment product. Examples of cosmetic products envisaged for use with the present invention include: cleansers; toners; eye gels; moisturisers; serums; body creams; body lotions; boosters; sunscreens; cream cleansers; foam cleaners; home cleaning products; liquid foundations; hair serums; hair treatments, including: dyes, bleaches, relaxers, hair gel, shampoo, hair glue, hair mouse, hair serum, hair spray, hair tonic, hair wax, pomade and beard oil; body oils; hair oils; face oils; hand creams; nail creams and conditioners; nail and cuticle oil and conditioners; antibacterial hand gels; antiviral hand gels; hand soaps; body soaps; shower gels; perfumes; primers; bronzers; sun protection lotions; masks; exfoliants; and hair removal products.

In other embodiments, the product is a pharmaceutical product, for example a topically applied gel, ointment, or cream. The product may be an ointment or gel for ophthalmic application, or a cream, ointment or gel for application to wounds. Such pharmaceutical products may in some embodiments be particularly sensitive to oxygen, or may comprise active ingredients which are particularly sensitive to oxygen.

In many embodiments, the product is a product which degrades at an accelerated rate when in contact with oxygen and/or moisture in the air, and thus has its storage life extended (and/or activity, safety or other desirable property preserved) by exposure to the air in storage and/or use being minimised, by use of a collapsible liner and a substantially airtight seal in accordance with the provisions of the present invention. This may advantageously slow degradation of the product.

According to certain embodiments, the cavity of the collapsible liner may have a standardised capacity for containing the product. For example, the capacity of the cavity may be in a range of from 3 to 500 ml.

For example, the capacity of the cavity may be in a range of from 10 to 200 ml, for example 10 to 150 ml, such as 10 to 100 ml, or 10 to 50 ml. In certain embodiments, the capacity may be 30 ml.

In some embodiments, particularly where the product is a pharmaceutical product, the capacity of the cavity may be in a range of from 3 to 50 ml, for example 3 to 30 ml, 3 to 20 ml, or 3 to 10 ml. In certain embodiments, the capacity may be 5 ml.

In certain embodiments, a device according to the invention is provided wherein the cavity of the collapsible liner is not (yet) filled with a product. For example, it is envisaged that the device, or simply the cartridge, of the invention, may be provided to a cosmetic manufacturer in order for the cavity of the collapsible liner to be filled with a product.

In other embodiments, a device according to the invention is provided wherein the cavity of the collapsible liner is filled with a product, especially any of the cosmetic products listed above.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings, of which.

DETAILED DESCRIPTION

Whilst the present invention has been described and illustrated with reference to particular embodiments, it will be appreciated by those of ordinary skill in the art that the invention lends itself to many different variations not specifically illustrated herein. By way of example only, certain possible variations will now be described.

Figure 1:
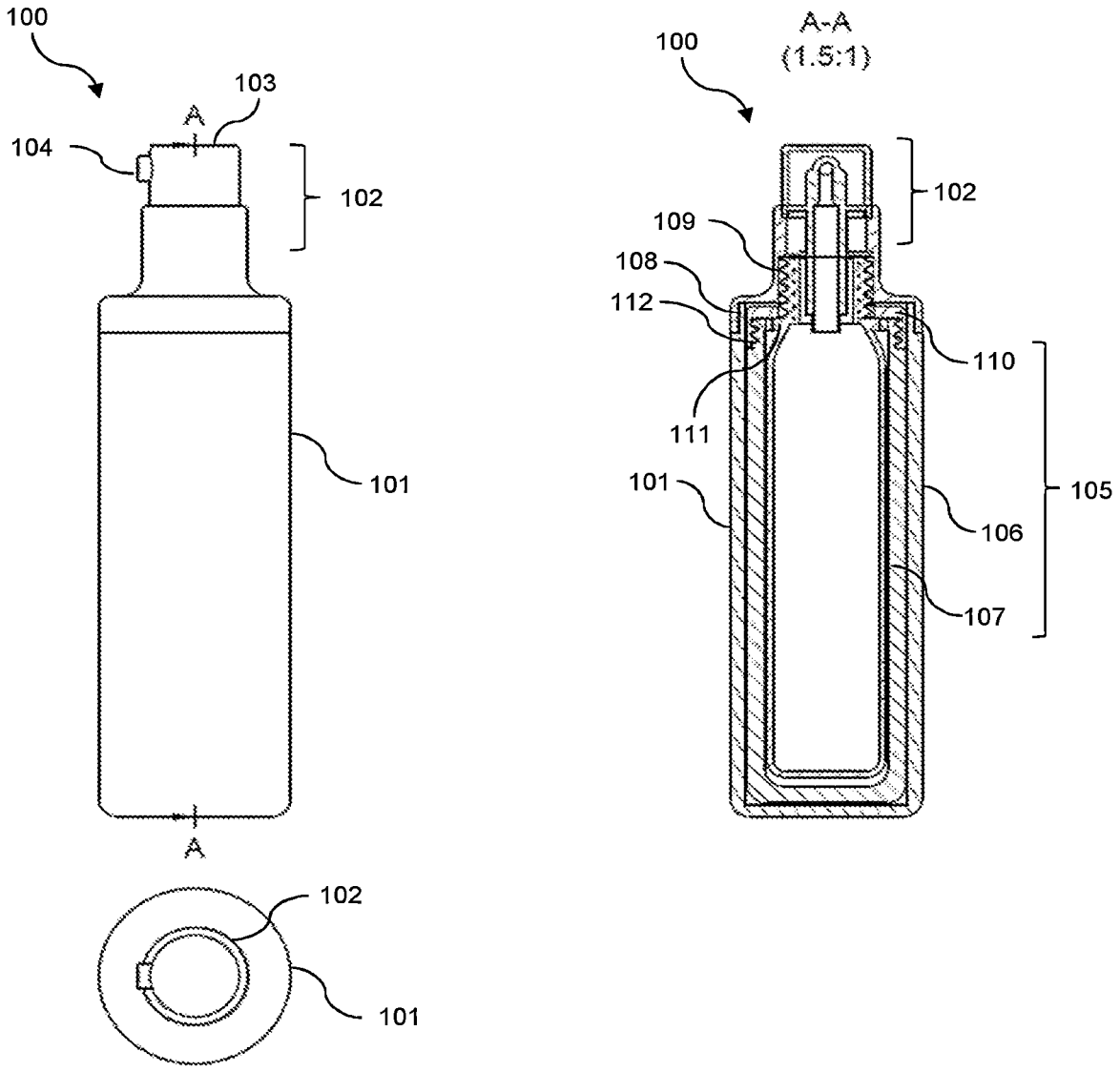
FIG. 1 shows side, top and cross-sectional views of a device according to one embodiment of the invention.

FIG. 1 shows a device 100 according to an embodiment of the invention. Visible in the side and top views are rigid container 101 and closure 102. Closure 102 comprises a depressible manual pump actuator 103 which may be depressed by the thumb of a user in order to pump cosmetic product out of the product container via product outlet 104. Visible in the cross-sectional view, in addition to rigid container 101 and closure 102, is cartridge 105 comprising rigid outer 106 and collapsible liner 107. Rigid container 101 engages with closure 102 by means of detents 108. Cartridge 105 engages with closure 102 by means of screw thread 109. Collapsible liner 107 engages with rigid outer 106 by means of annular collar 111, which is shaped to engage with a complementary annular section of rigid outer 106. Screw-down ring 110 is optional, and may help secure annular collar 111 in place. Optionally, screw-down ring 110 may engage with rigid outer 106 by means of screw thread 112. It will be appreciated that where screw threads are shown in FIG. 1, these could be replaced in other embodiments with alternative engagement means, for example detents. Likewise, where detents are shown in FIG. 1, these could be replaced in other embodiments with screw threads.

Figure 2:
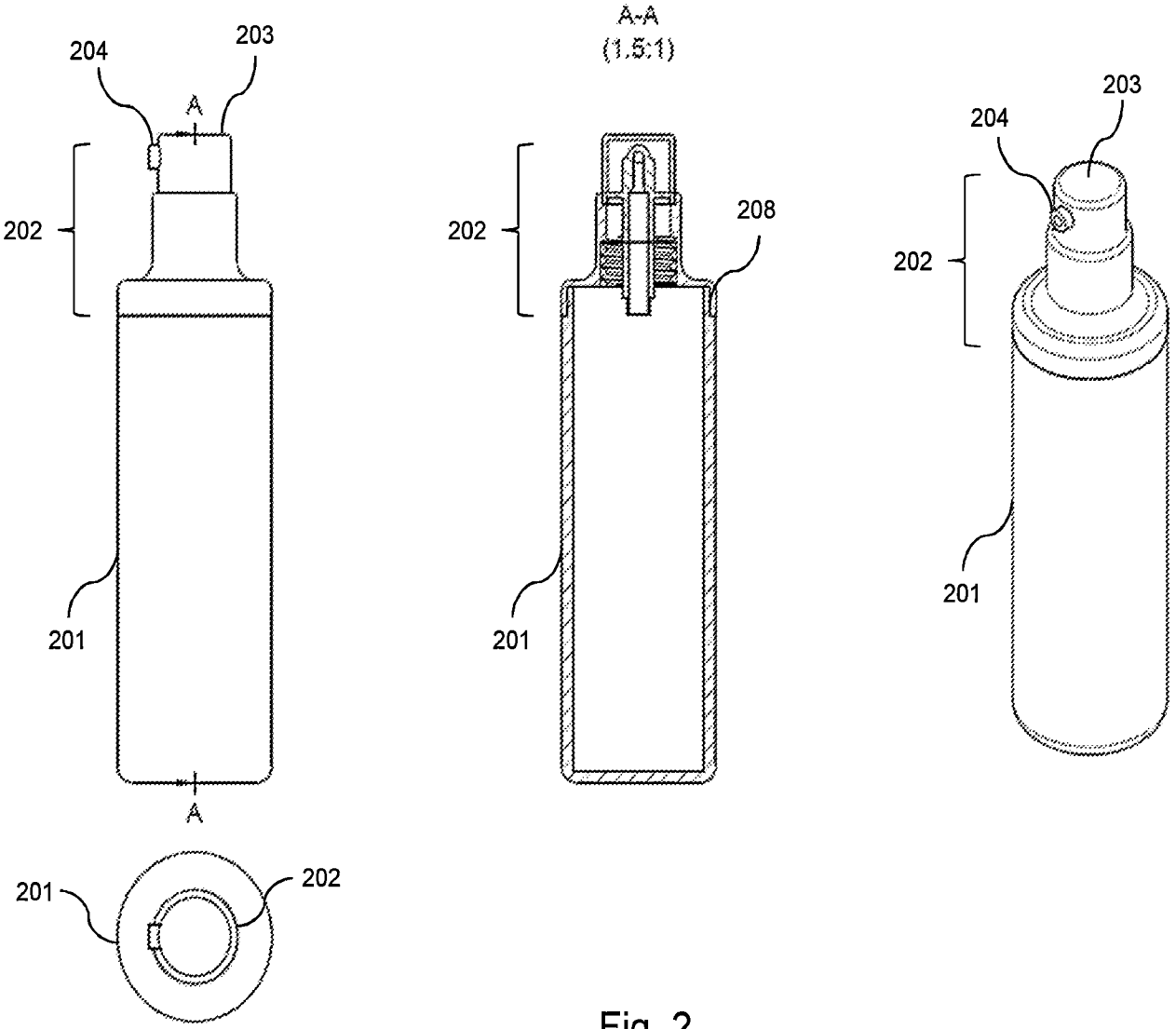
FIG. 2 shows side, top, cross-sectional and perspective views of a rigid container and a closure.

FIG. 2 shows a rigid container 201 together with a closure 202 (closure 202 comprising depressible manual pump actuator 203 and product outlet 204). Rigid container 201 engages with closure 202 by means of detents 208. It will be appreciated that in alternative embodiments, detents 208 could be replaced with other engagement means, for example a screw thread.

Figure 3:
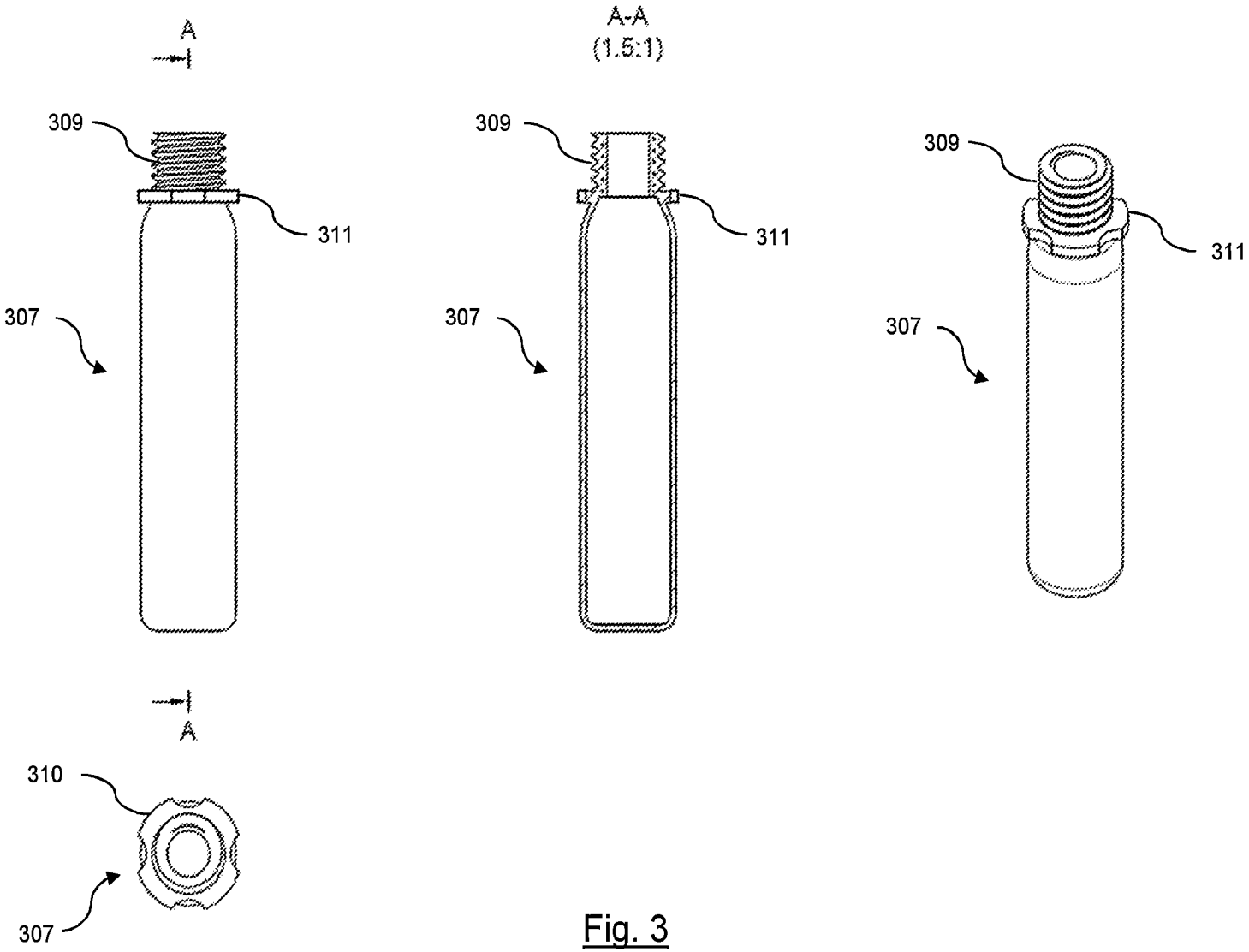
FIG. 3 shows side, top, cross-sectional and perspective views of a collapsible liner.

FIG. 3 shows a collapsible liner 307, having a screw thread 309 for engaging with a closure of the device (not shown) and an annular collar 311. Annular collar 311 is shaped for engagement with a rigid outer of the device (not shown).

Figure 4:
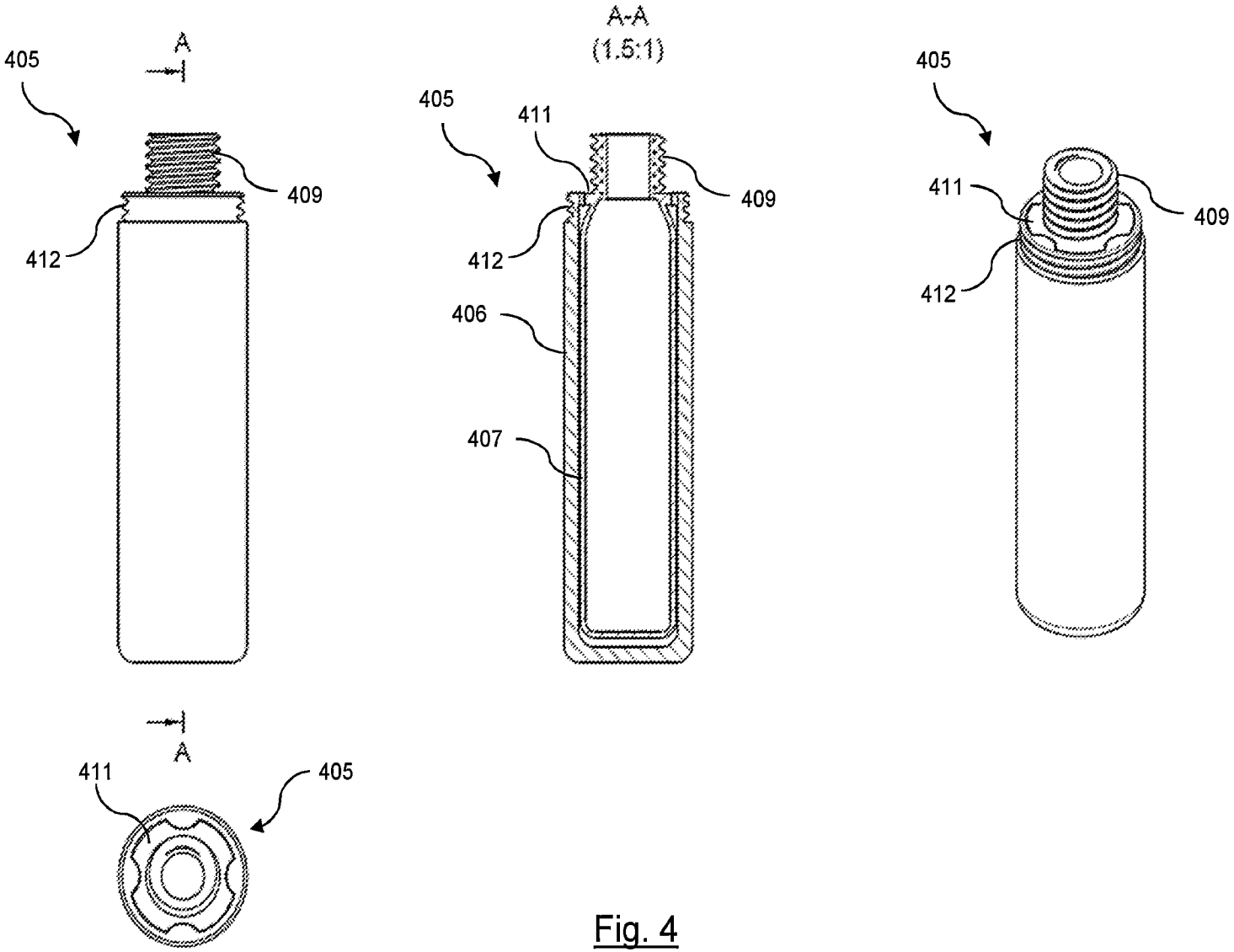
FIG. 4 shows side, top, cross-sectional and perspective views of a cartridge.

FIG. 4 shows a cartridge 405, comprising rigid outer 406 and collapsible liner 407. Collapsible liner 407 engages with rigid outer 406 by means of annular collar 411, which is shaped to engage with a complementary annular section of rigid outer 406. Screw thread 409 is configured to engage with a closure of the device (not shown). Optional screw thread 412 is configured to engage with an optional screw-down ring of the cartridge of the device (not shown).

Figure 5:
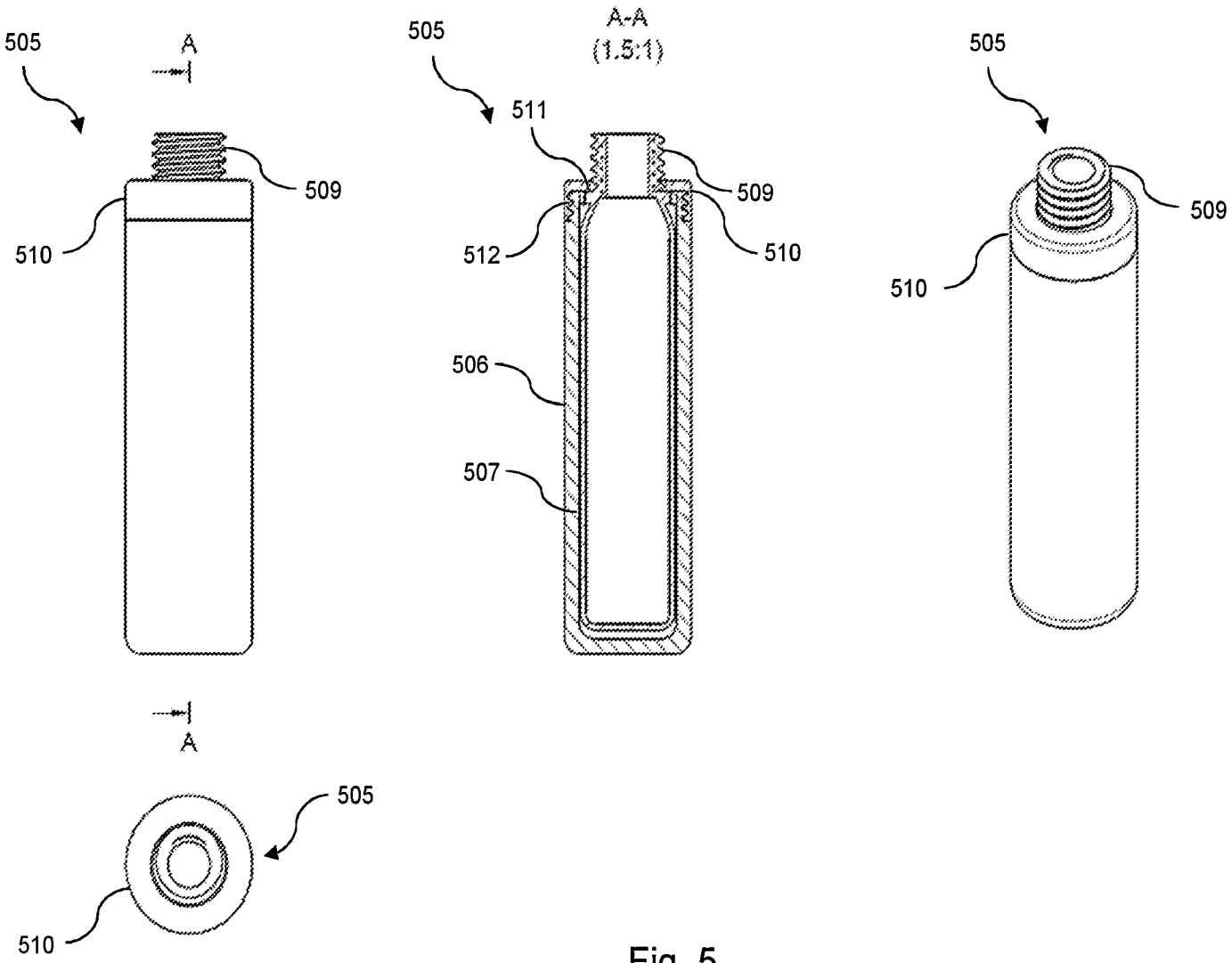
FIG. 5 shows side, top, cross-sectional and perspective views of a cartridge including a screw-down ring.

FIG. 5 shows side, top, cross-sectional and perspective views of a cartridge 505, including an optional screw-down ring 510. Annular collar 511 of collapsible liner 507 engages with a complementary annular section of rigid outer 506. This restricts undesirable movement (for example rotation) of liner 507 relative to outer 506 when the rigid container is engaged with and/or disengaged from the closure, but liner 507 and outer 506 may nonetheless be decoupled by a user, for separate disposal. Optional screw-down ring 510 engages with screw thread 512. Thus, optional screw-down ring 510 supplements the action of annular collar 511, helping avoid undesirable movement (for example rotation) of liner 507 relative to outer 506. Optional screw-down ring 510 may also help prevent liner 507 from collapsing inwards, i.e., inside outer 506.

Figure 6:
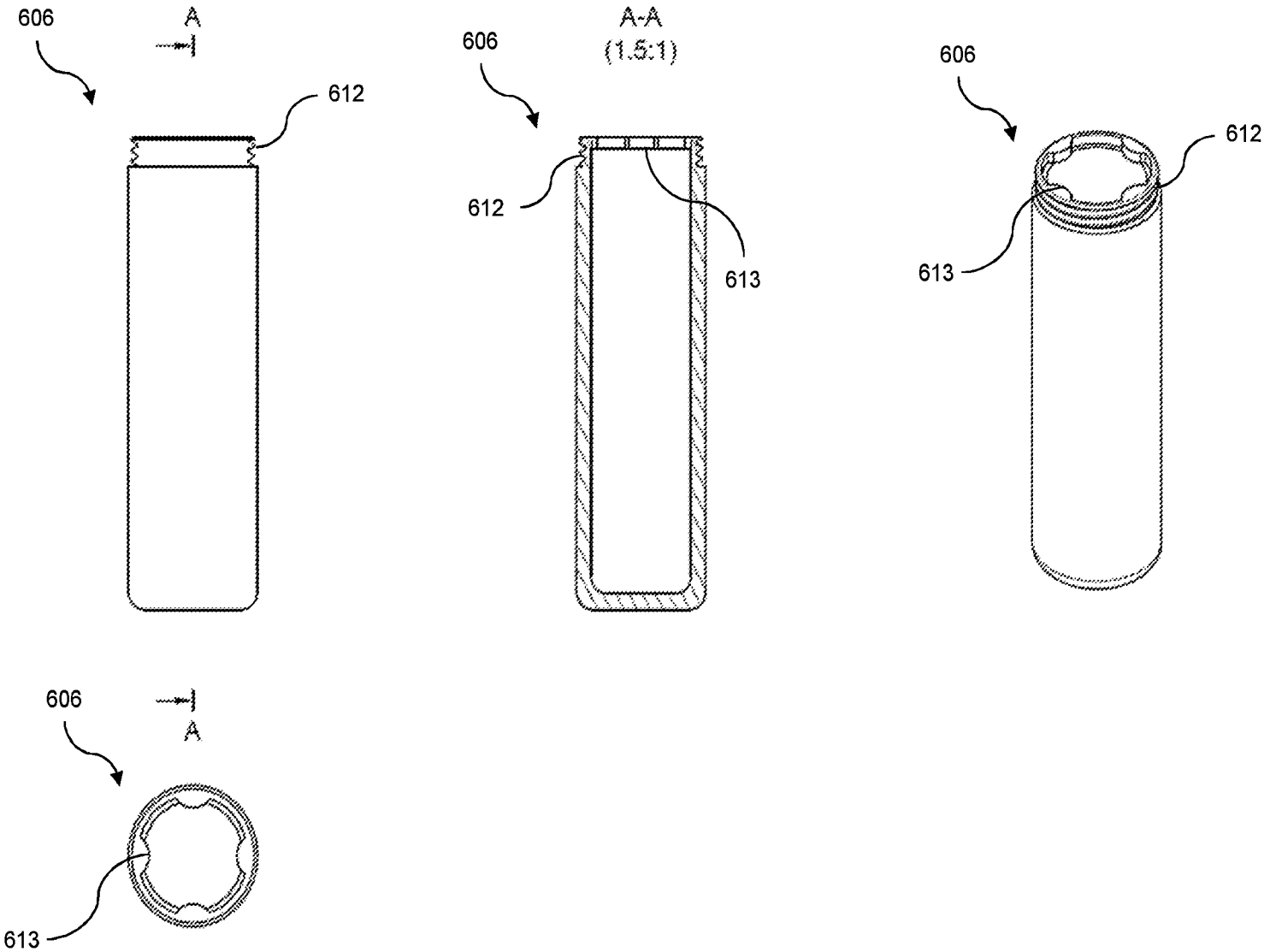
FIG. 6 shows side, top, cross-sectional and perspective views of a rigid outer.

FIG. 6 shows side, top, cross-sectional and perspective views of a rigid outer 606. In use, the annular collar of a collapsible liner of the device (not shown) engages with a complementary annular section 613 of rigid outer 606.

Figure 7:
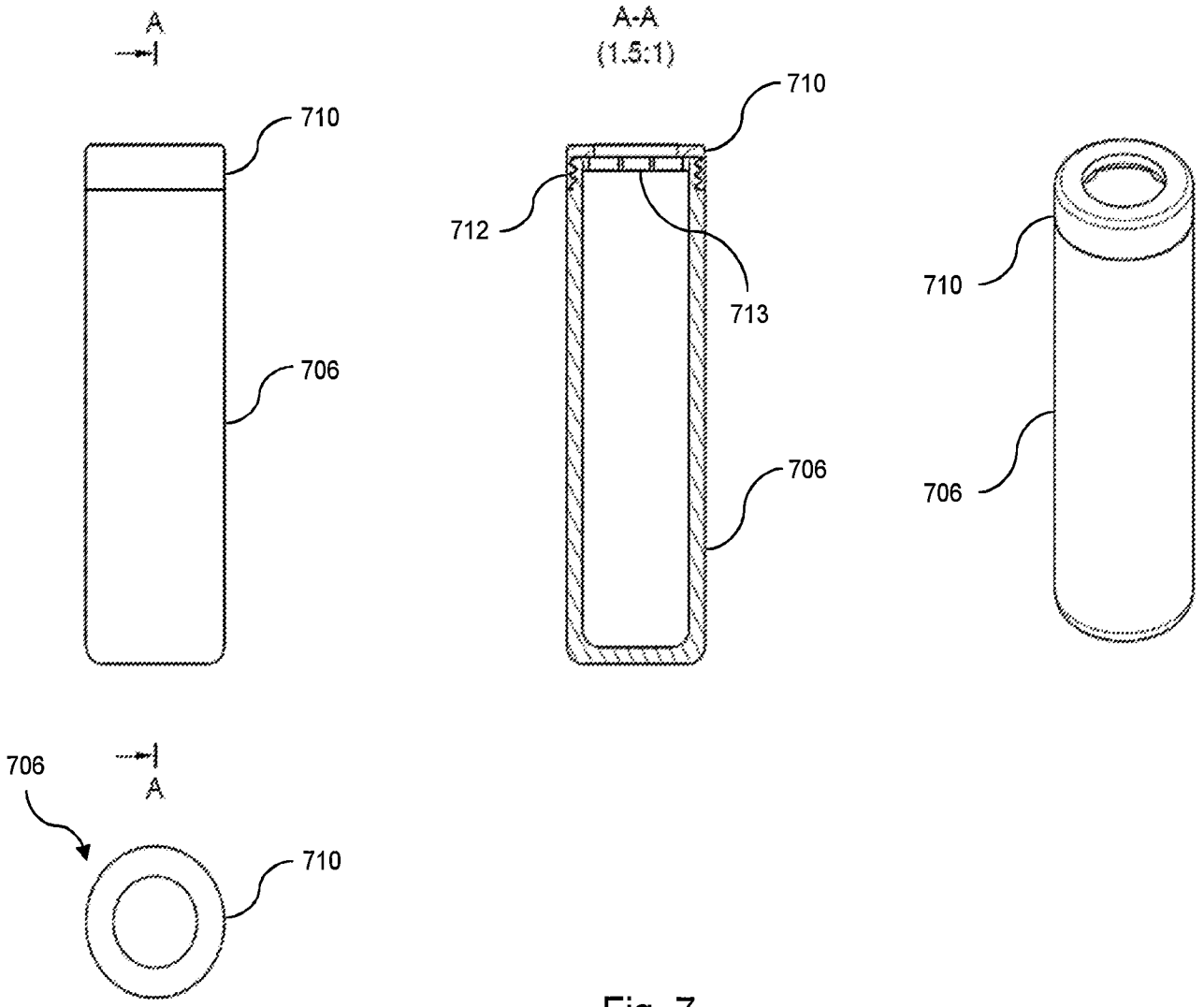
FIG. 7 shows side, top, cross-sectional and perspective views of a rigid outer, together with a screw-down ring.

FIG. 7 shows side, top, cross-sectional and perspective views of a rigid outer 706, with an optional screw-down ring 710 in place.

Figure 8:
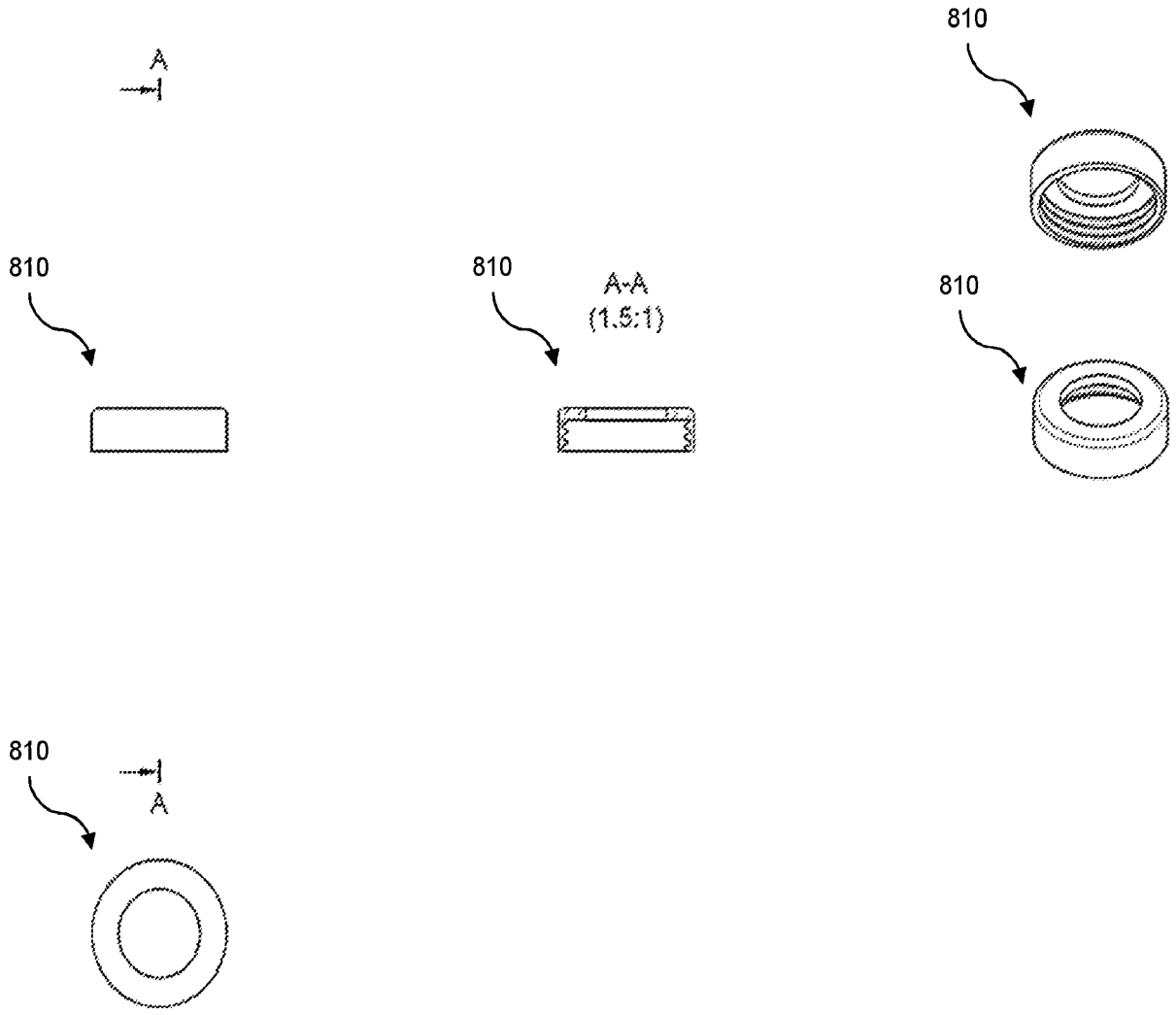
FIG. 8 shows side, top, cross-sectional and perspective views of a screw-down ring.

FIG. 8 shows side, top, cross-sectional and perspective views of an optional screw-down ring 810.

Figure 9:
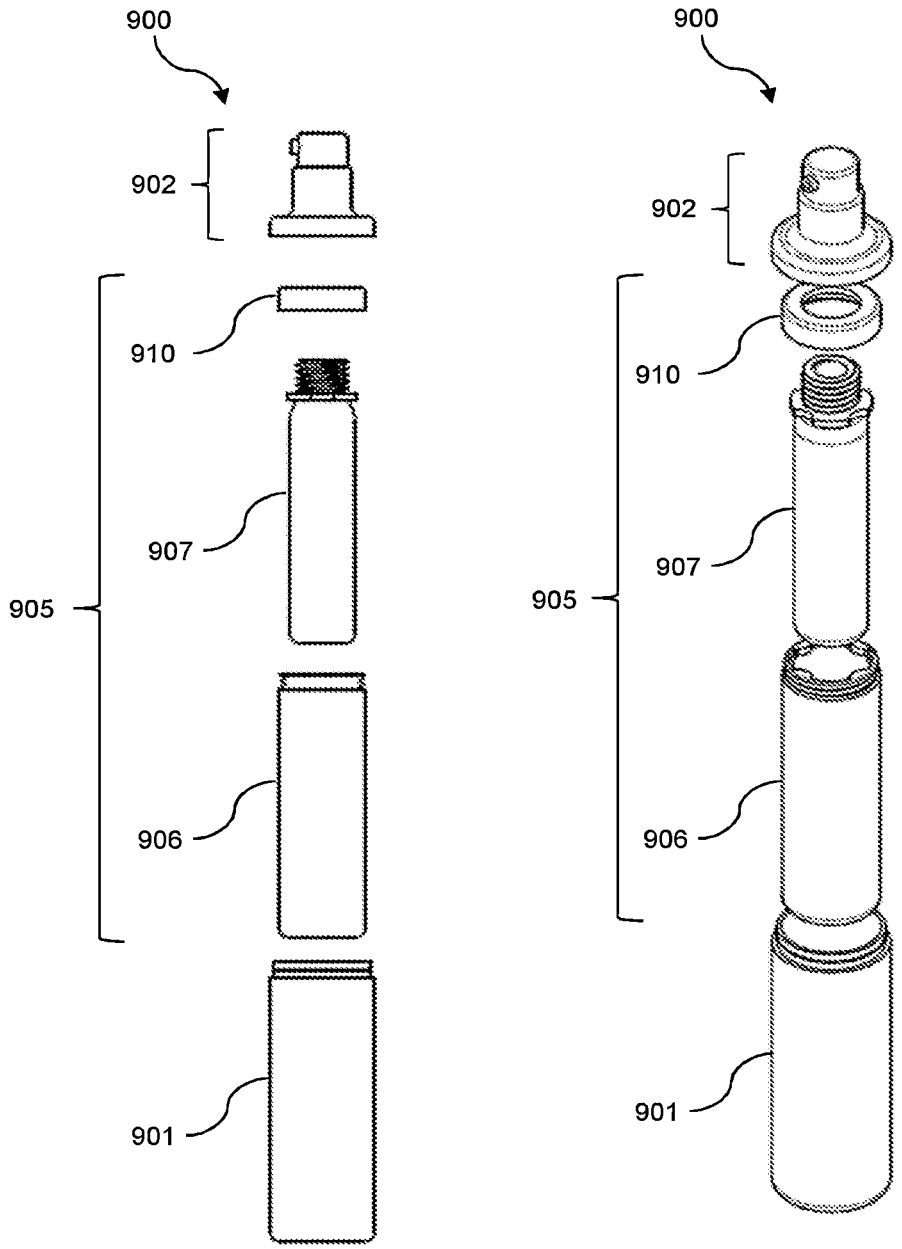
FIG. 9 shows side and perspective exploded views of a device.

FIG. 9 shows side and perspective exploded views of a device 900, according to the embodiment of the invention shown in FIG. 1. In use, rigid container 901 engages with closure 902, thereby closing rigid container 901, and cartridge 905 is enclosed within rigid container 901. Cartridge 905 comprises rigid outer 906, which encloses collapsible liner 907. Collapsible liner 907 defines a cavity for containing a product, wherein a product withdrawing conduit (not shown) of the closure extends inside the cavity. Optional screw-down ring 910 is also comprised in the cartridge 905 of FIG. 9.

Figure 10:
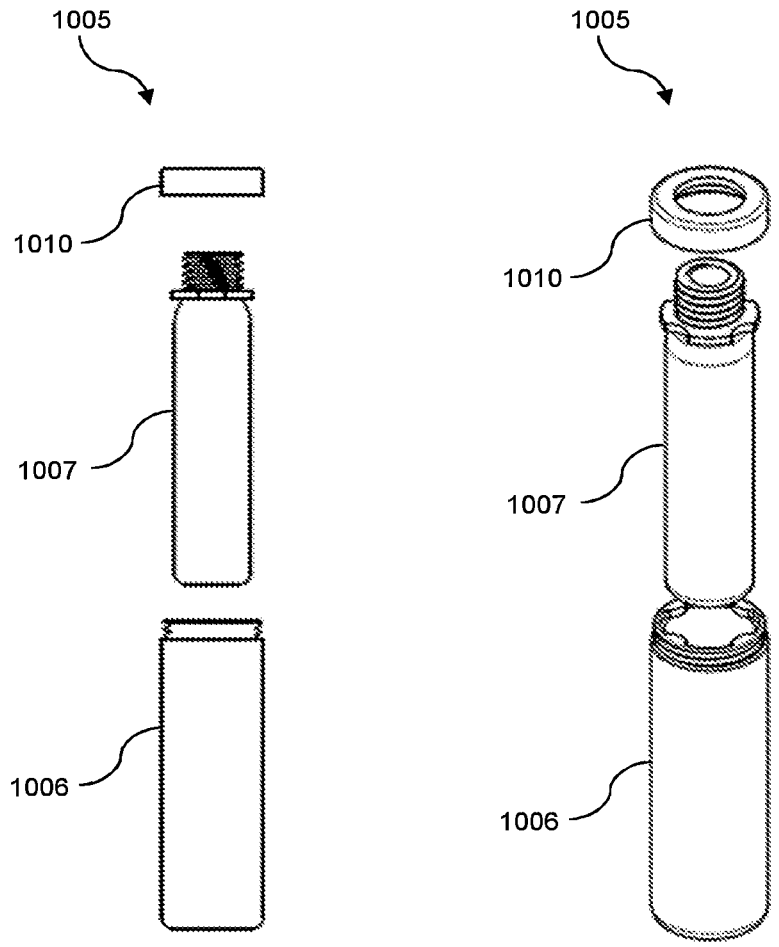
FIG. 10 shows side and perspective exploded views of a cartridge including a screw-down ring.

FIG. 10 shows side and perspective exploded views of a cartridge 1005, including an optional screw-down ring 1010.

Figure 11:
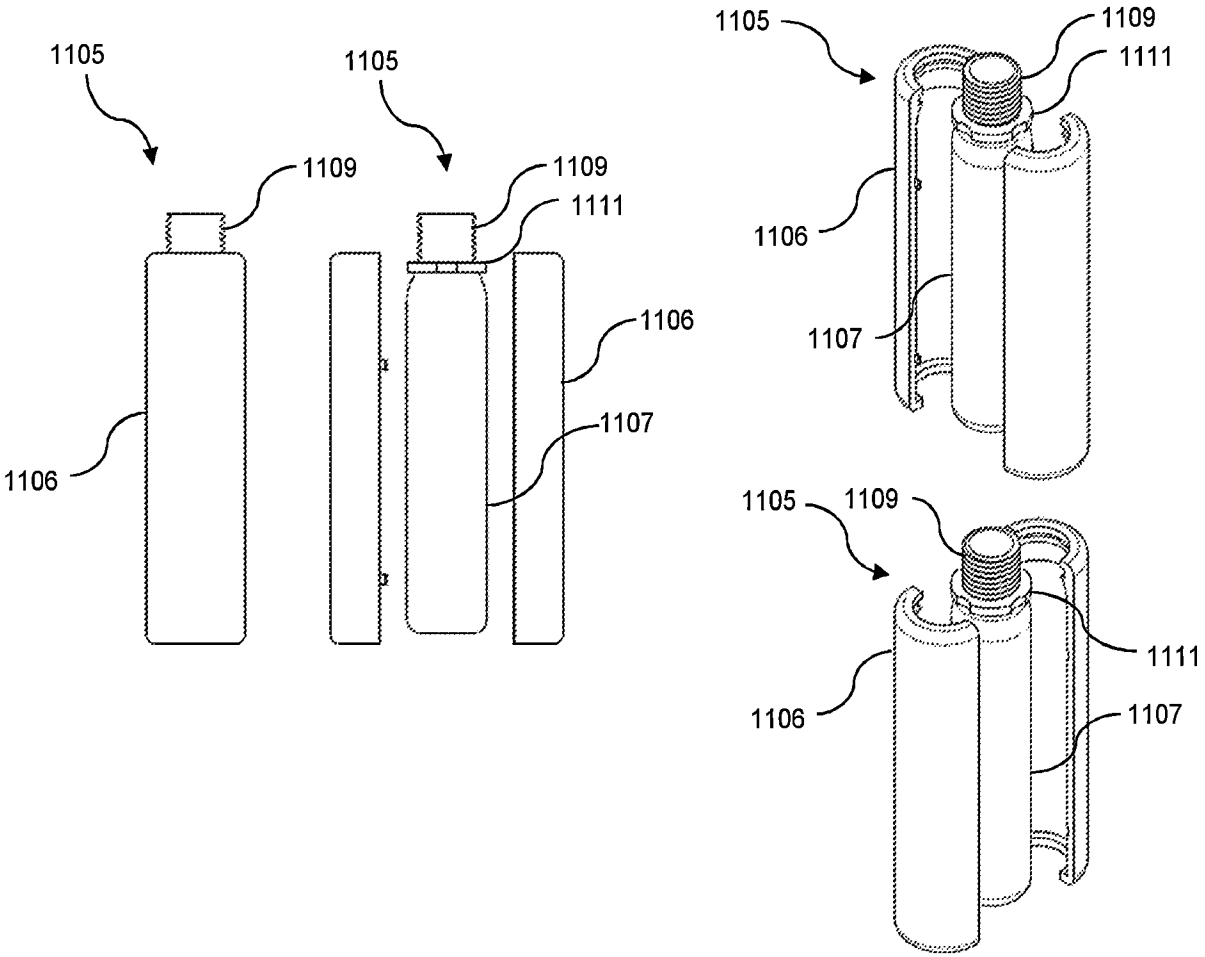
FIG. 11 shows side and perspective exploded views of a cartridge.

FIG. 11 shows side and perspective exploded views of a cartridge 1105. In this embodiment, rigid outer 1106 is provided in two halves, which clip into place around collapsible liner 1107.

Figure 12:
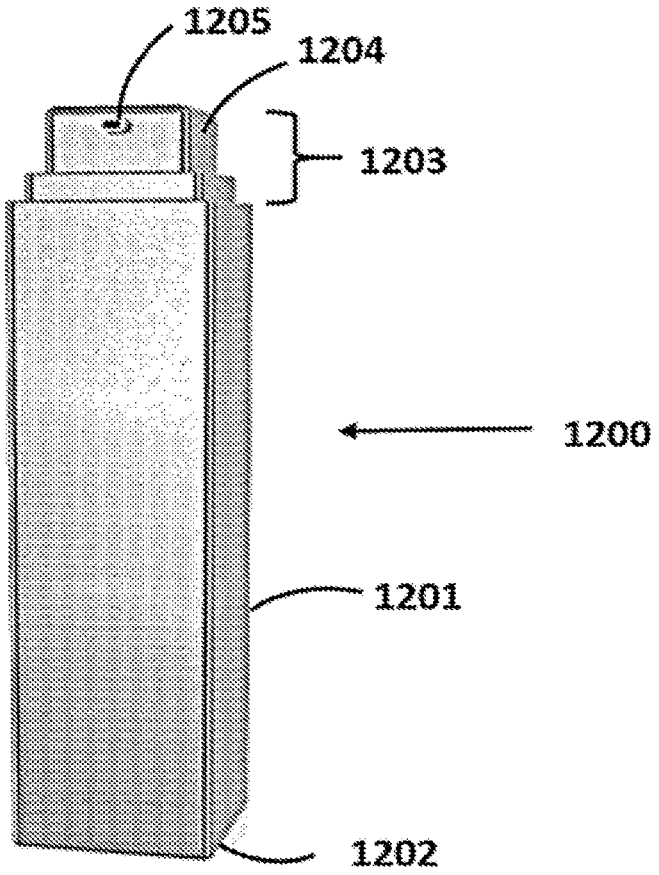
FIG. 12 shows a side view of a device according to an alternative embodiment of the invention, with a rigid container and a closure in view.

FIG. 12 shows a side view of a device 1200 according to an alternative embodiment of the invention. Rigid container 1201 comprises a body of approximately square cross-section. A bottom closure 1202 attaches to the body of rigid container 1201. Closure 1203 comprises a depressible manual pump actuator 1207 which may be depressed by the thumb of an operator in order to pump cosmetic product out of the device via product outlet 1205.

Figure 13:
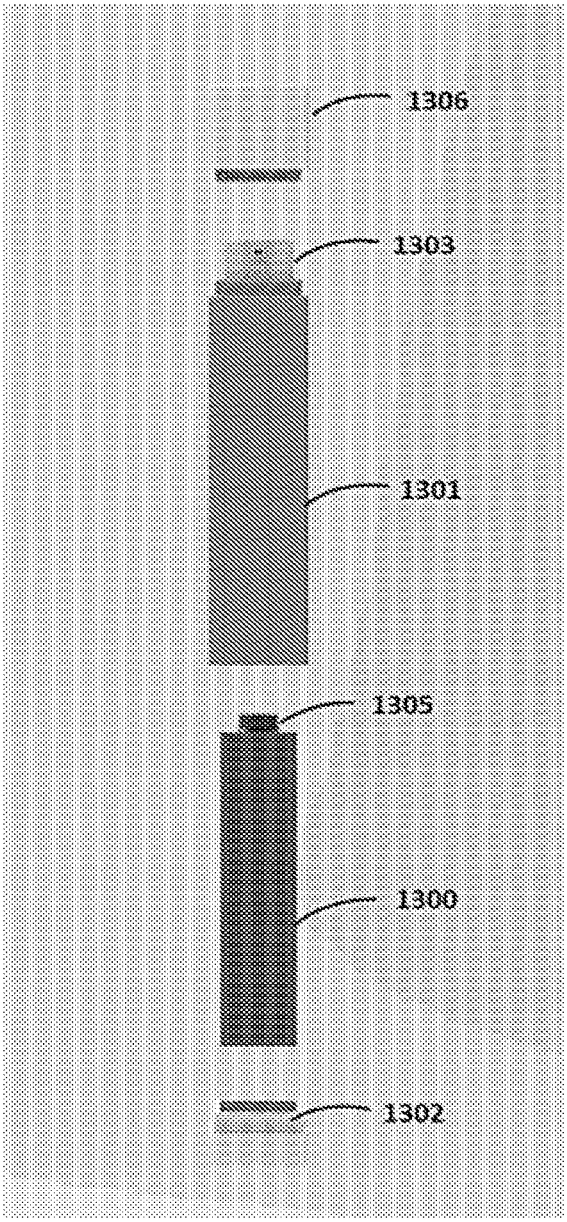
FIG. 13 shows an exploded view of the device of FIG. 12.

FIG. 13 shows an exploded of the device of FIG. 12. It can be seen that the bottom closure 1302 has been removed, to release cartridge 1300, in which a product is contained. Cartridge 1300 has an open-necked portion 1305. Also shown is an optional lid 1306, which fits over closure 1303 of rigid container 1301 and is absent in FIG. 12.

Figure 14:
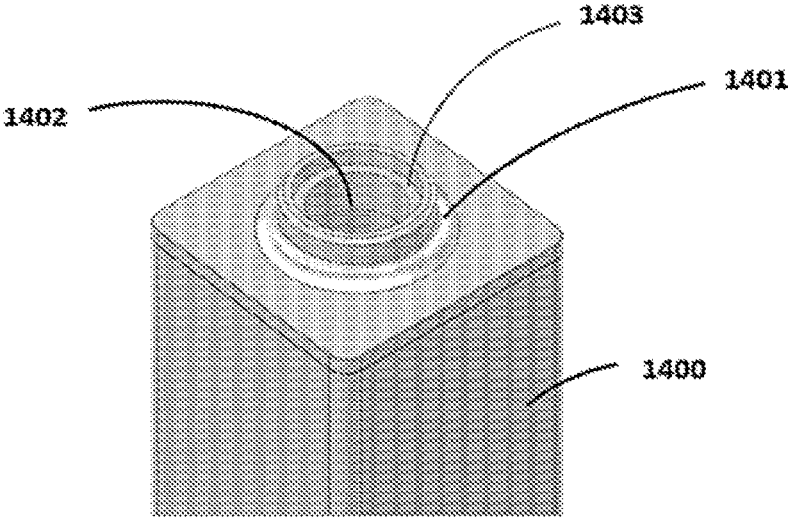
FIG. 14 shows in detail a perspective view of part of a cartridge, including an opening adapted to receive a product withdrawing conduit.

FIG. 14 shows in detail a perspective view of part of cartridge 1400, specifically open-necked portion 1401. It can be seen that open-necked portion 1401 has an opening 1402 through which product may be withdrawn. The opening is circular in cross-section and thus has an internal surface which is a cylindrical bore. The opening may optionally be closed by means of a sealing foil (not shown) fitted across the top of the opening. A tight seal between a product withdrawing conduit (not shown) and the bore of the opening may be achieved by locating a gasket of elastomeric material in the inner surface of the bore of the opening at position 1403 of FIG. 14 (gasket not shown). By placing a gasket in the cartridge, the gasket may operate to wipe the product withdrawing conduit clean of residual product when the cartridge is removed from the device, thereby reducing mess. Placing the gasket on the replaceable cartridge rather than the reusable rigid container also means that the gasket does not need to withstand the wear and tear of long-term use.

Figure 15:
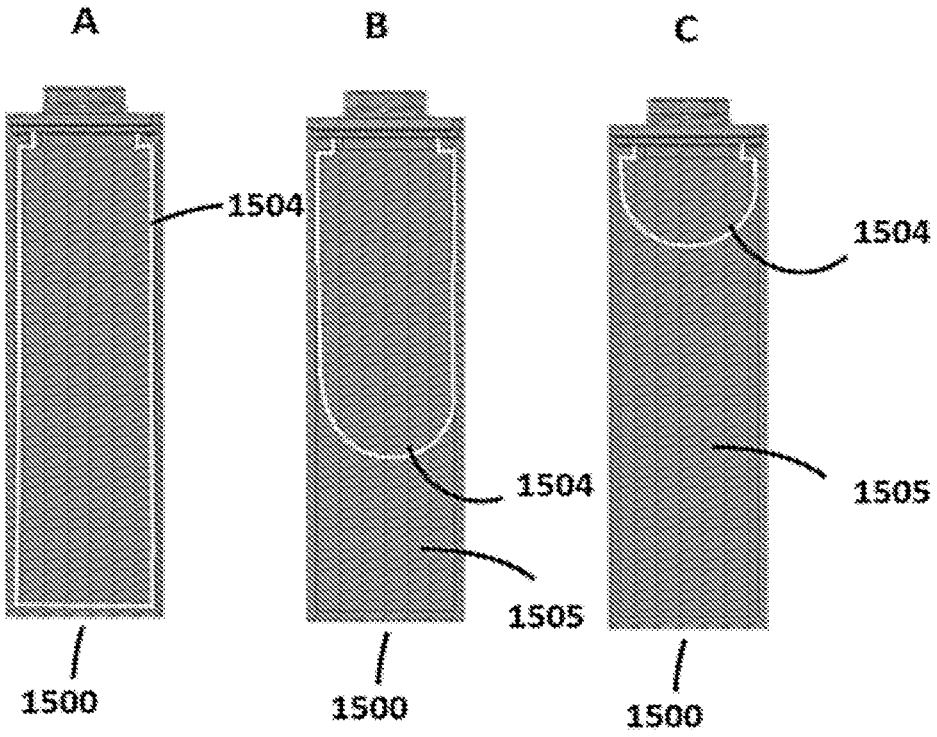
FIG. 15 shows diagrammatically the position of a collapsible liner within a rigid outer, and illustrates progressive collapse of the liner as product is withdrawn for use.

FIG. 15 shows the arrangement of collapsible liner 1504 within rigid outer 1500. The view of Part A illustrates the configuration when collapsible liner 1504 is full of a product. Parts B and C show progressive emptying and collapse of liner 1504, as product is removed. The wall of the rigid outer may contain an opening to assist admittance of atmospheric air into the gap 1505 between the inner wall of the rigid outer and the collapsible liner 1504, as the liner 1504 collapses.

Figure 16:
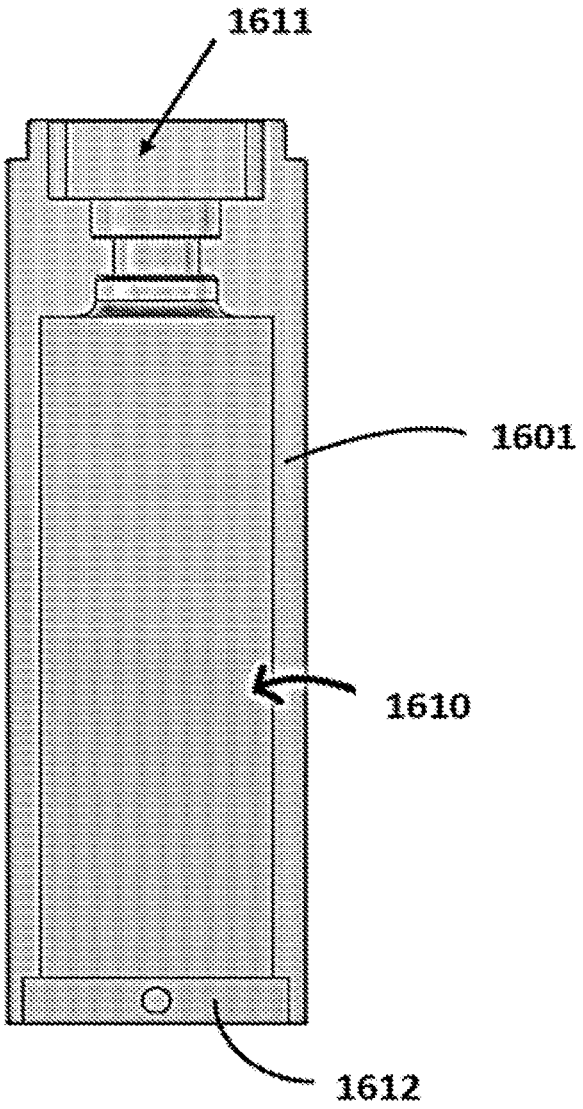
FIG. 16 shows a cross-sectional view of a rigid container.

The rigid container may be constructed of a durable, attractive material such as brushed aluminium, and may be machined or otherwise fabricated with, as shown in cross-section in FIG. 16, a cavity 1610 to receive a cartridge, a cavity 1611 to receive a pump mechanism and a suitable arrangement 1612 to receive a bottom closure.

Figure 17:
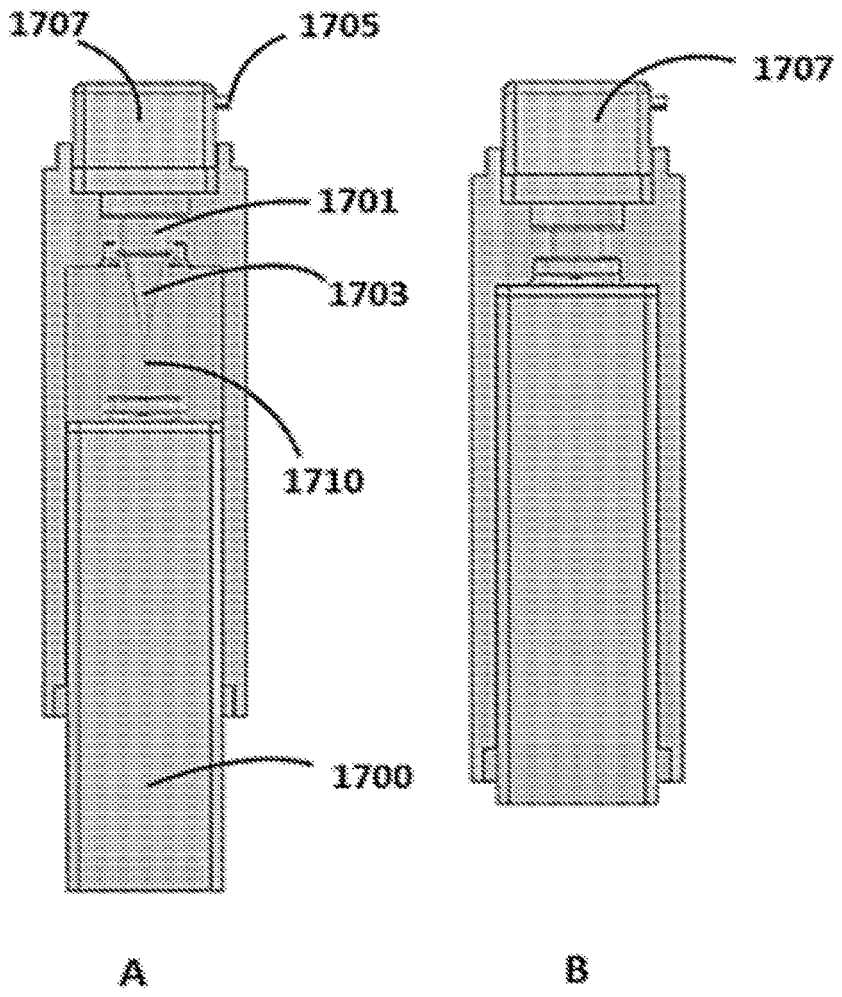
FIG. 17 shows a cross-sectional view, in progress, of the rigid container and cartridge of the device of FIG. 12 being coupled together. Part A shows the cartridge partially inserted into the rigid container, and Part B shows the cartridge fully installed.

FIG. 17 shows, in cross-section in Part A, a rigid container 1701, together with a manual pump having a pump actuator 1707 and a product dispensing outlet 1705. Also visible in Part A is a product withdrawing conduit having a cylindrical portion 1701 and a substantially conical portion 1703. Part A shows the partial insertion of a cartridge 1700 into cavity 1710. The cartridge may be inserted further into this position, as shown in Part B. As can be seen in Part B, the product withdrawing conduit is received in the opening of the cartridge 1700, such that the substantially conical portion 1703 has pierced a foil (not shown) across the opening of the cartridge 1700, and the cylindrical portion 1701 fills the bore of the cartridge opening. By placing a product in a collapsible liner inside the rigid outer of the cartridge, exposure of the product to the atmosphere is avoided and, provided that the cylindrical portion 1701 of the product withdrawing conduit and the bore of the cartridge opening form an airtight seal, product may be withdrawn until the cartridge 1700 is substantially empty, without the product withdrawing conduit needing to extend very far into the cavity of the collapsible liner. This also allows product to be dispensed when the device is inverted. A shorter product withdrawing conduit reduces the potential for it to be damaged, and reduces the amount of residual product clinging to it when cartridge 1700 is removed from the device.

Figure 18:
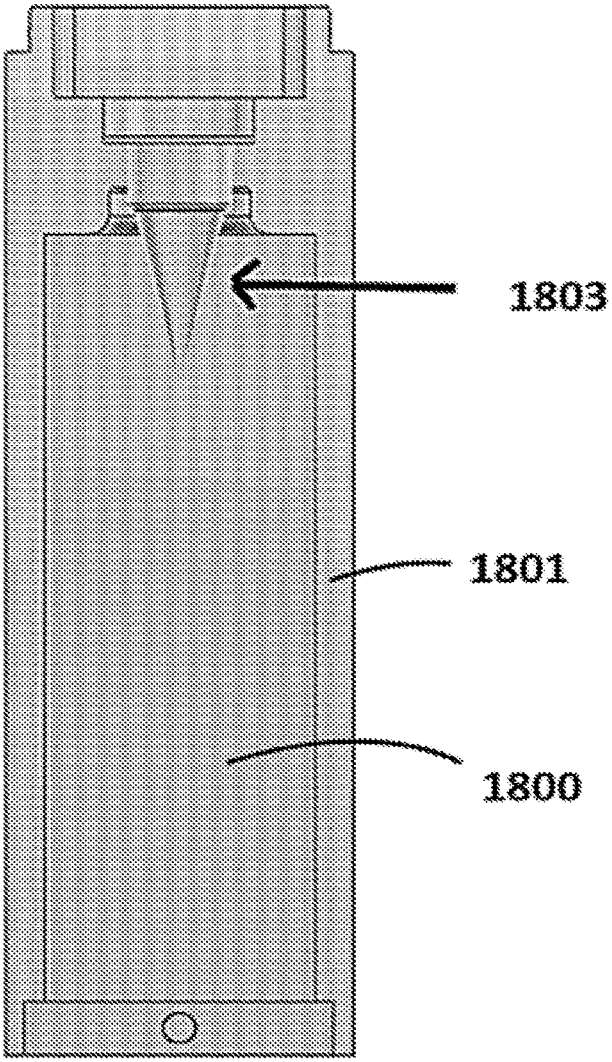
FIG. 18 shows a cross-sectional view of a cartridge installed in the rigid container of the device of FIG. 12, with the product withdrawing conduit in place in the opening of the cartridge.

FIG. 18 shows the cartridge 1800 in place and illustrates how the substantially conical portion 1803 of the product withdrawing conduit is inside the cartridge in this configuration.

Figure 19:
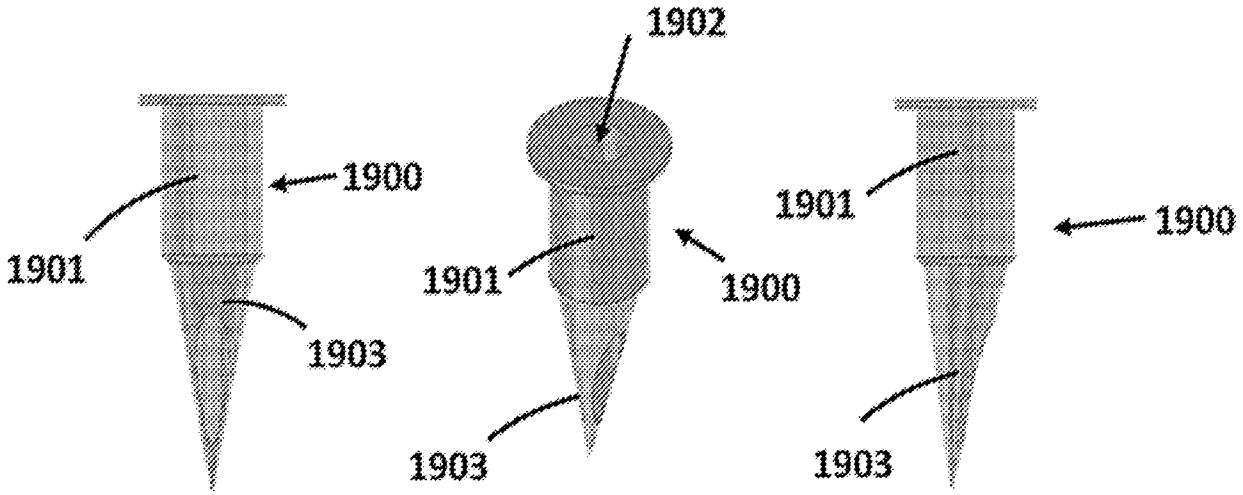
FIG. 19 shows side and perspective views of a product withdrawing conduit.

FIG. 19 shows, in multiple views, an illustrative product withdrawing conduit 1900 in accordance with the invention. It comprises a cylindrical portion 1901 having an internal bore 1902. The cylindrical portion is dimensioned to be received by the opening of a rigid cartridge of the device (not shown). The product withdrawing conduit 1900 is at one end spiked into a substantially conical shape, suitable for piercing a sealing foil across the top of the opening of the rigid cartridge. The internal bore 1902 opens in the side wall of the substantially conical portion 1903; its position means it is unlikely to become blocked by a sealing foil.

Figure 20:
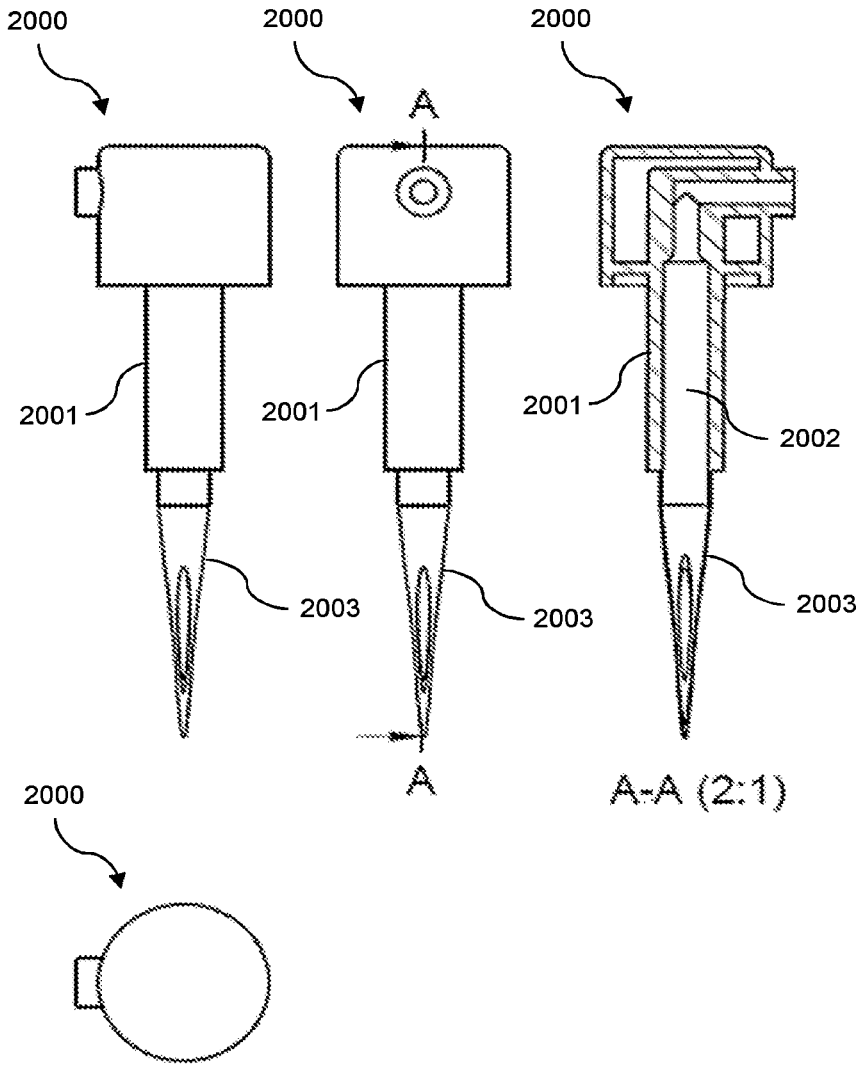
FIG. 20 shows side, top, front and cross-sectional views of a product withdrawing conduit.

FIG. 20, like FIG. 19, shows an illustrative product withdrawing conduit 2000 in accordance with the invention. It comprises a cylindrical portion 2001 having an internal bore 2002. The cylindrical portion is dimensioned to be received by the opening of a rigid cartridge of the device (not shown). The product withdrawing conduit 2000 is at one end spiked into a substantially conical shape, suitable for piercing a sealing foil across the top of the opening of the rigid cartridge. The internal bore 2002 opens in the side wall of the substantially conical portion 2003; its position means it is unlikely to become blocked by a sealing foil.

Figure 21:
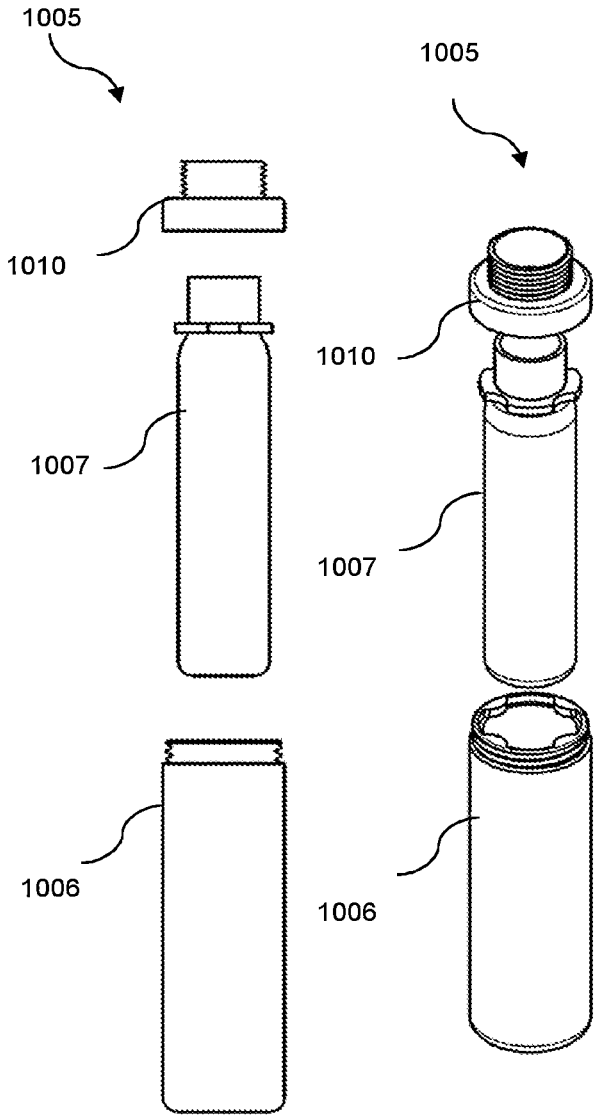
FIG. 21 shows an exploded view of a cartridge including a screw-down ring which is provided with a screw tread for engagement with the closure.
Figure 22:
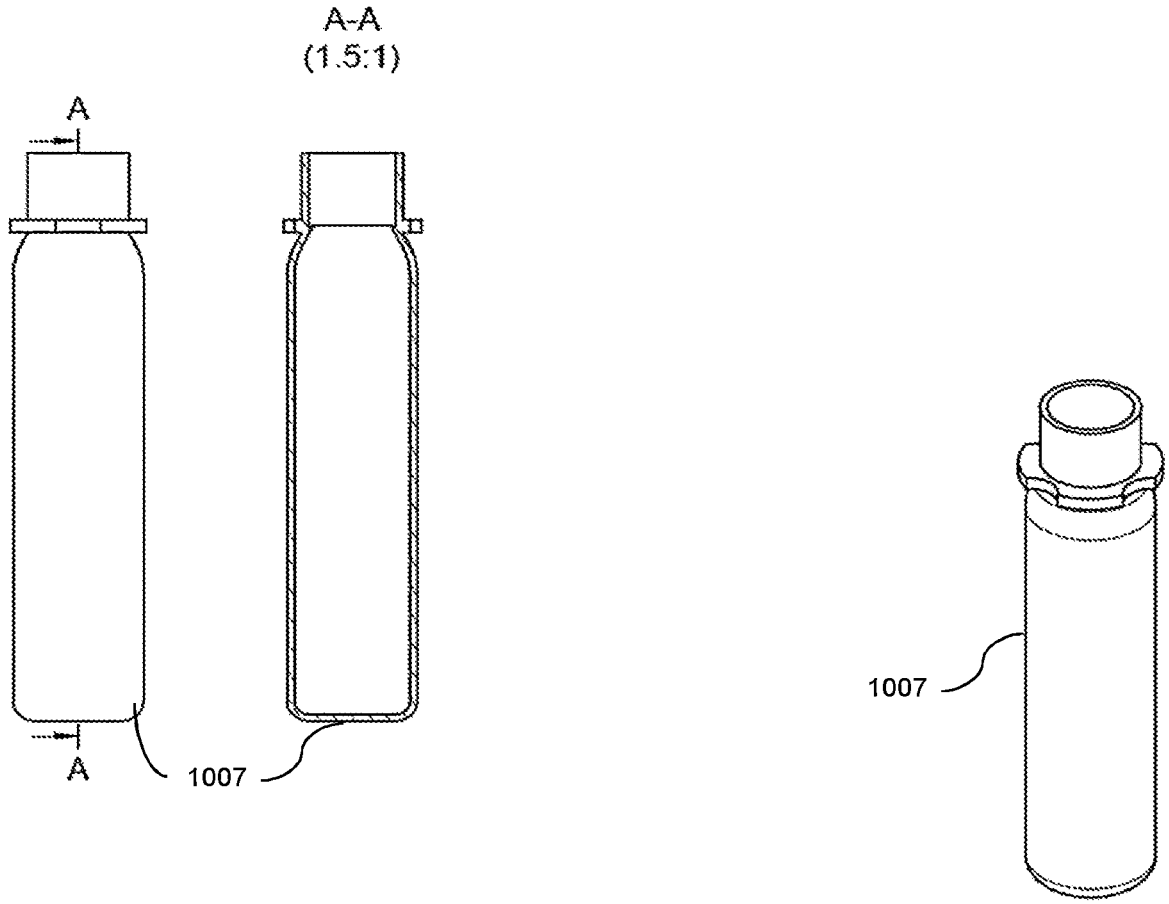
FIG. 22 show a collapsible liner as used in the arrangement illustrated in FIG. 21.

FIG. 21 shows side and perspective exploded views of a cartridge 1005, including an optional screw-down ring 1010. In contrast to the arrangement illustrated in FIG. 10, it can be seen that the screw tread for engaging with the closure is provided as part of the screw-down ring, whereas in the arrangement shown in FIG. 10, that screw-thread is provided as part of the rigid outer which protrudes beyond the screw-down ring. The absence of the screw-tread on the collapsible liner in accordance with the arrangement illustrated in FIG. 21, is shown clearly in FIG. 22 which is an illustration of the collapsible liner alone. It can be seen form FIG. 22, that the collapsible liner without the screw-tread is advantageously simple in form.

Figure 23:
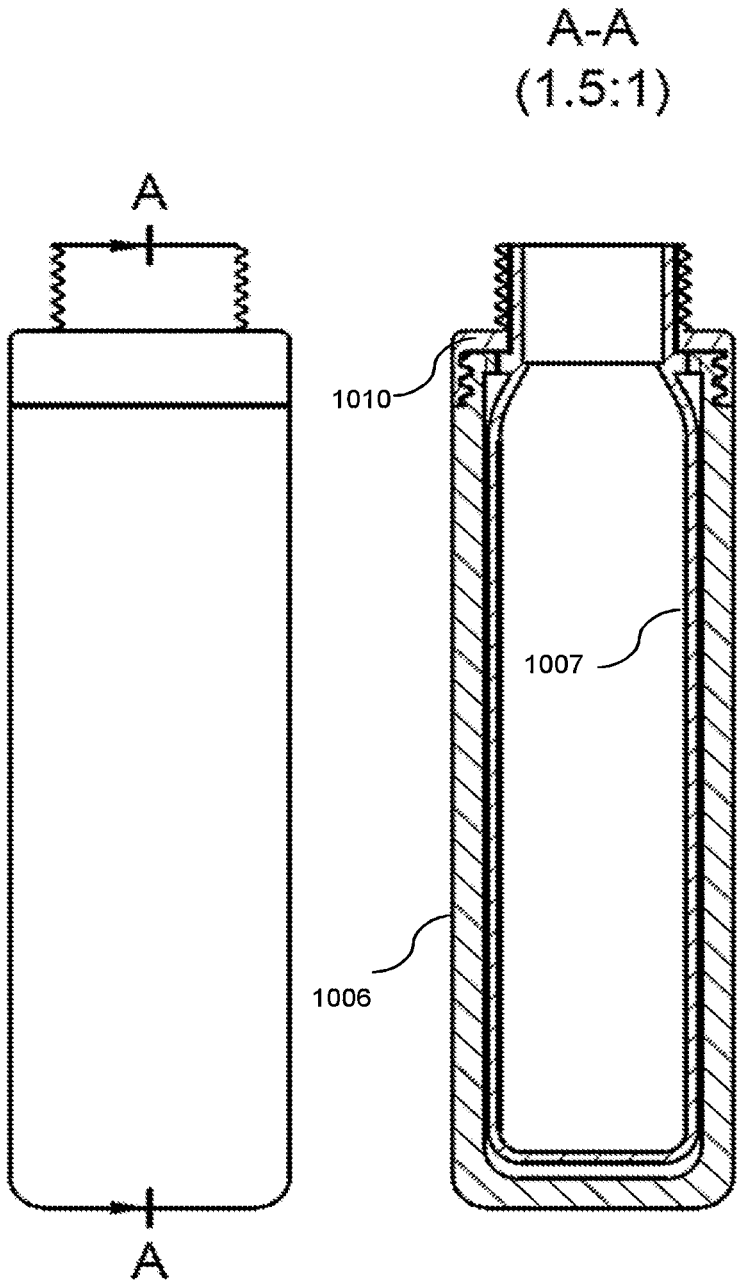
FIG. 23 shows a cartridge of FIG. 21 in cross-sectional view.

FIG. 23 shows a cross section of a cartridge as illustrated in FIG. 21. As can be seen, when the cartridge is assembled from the collapsible liner and the rigid outer, the means for engaging with the closure, in this case a screw tread, is provided as part of the screw down ring. This means that the neck of the collapsible liner is mechanically strengthened by the screw-down ring which means that sufficient robustness can be provided in the means for engaging with the closure whilst only requiring the use of a minimal amount of material for the collapsible liner.

Figure 24:
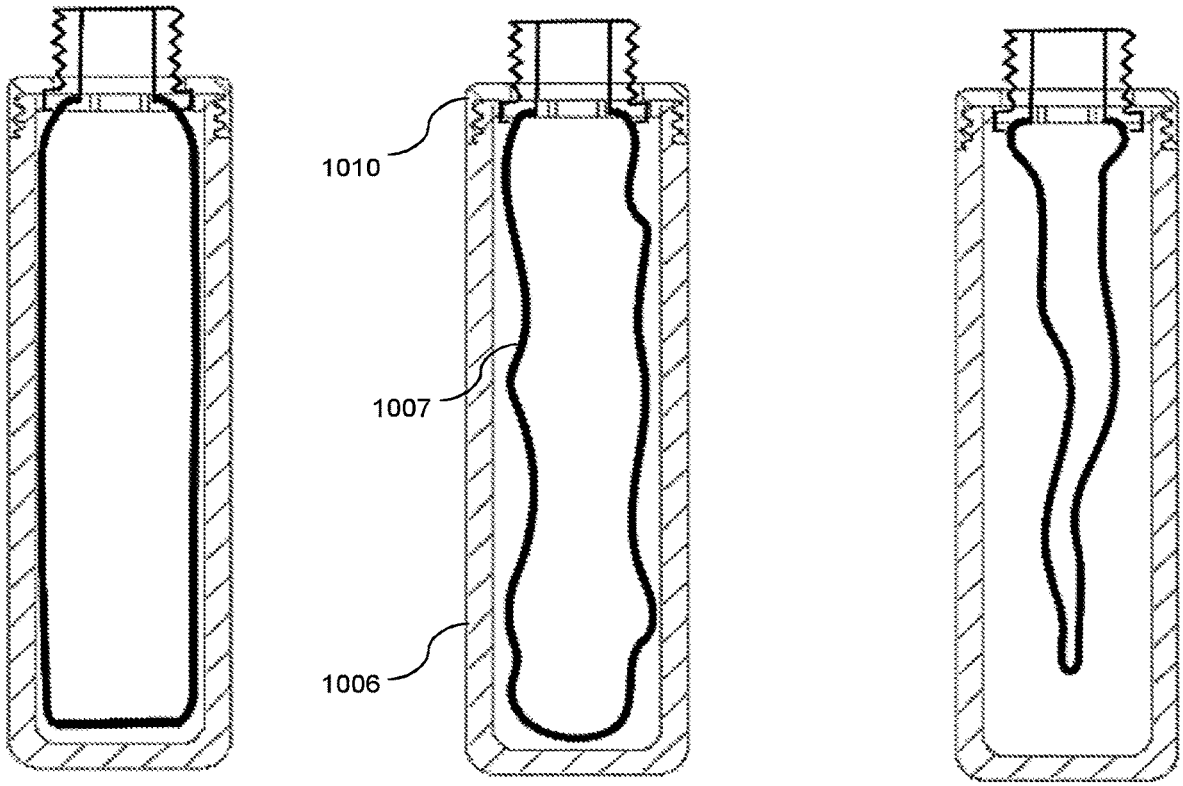
FIG. 24 shows a cross-sectional view of a cartridge and illustrates the progressive collapse of the collapsible liner.

FIG. 24 shows a cross-section of a cartridge of the invention which comprises a rigid outer 1006 and a collapsible liner. The three-illustrations show progressive collapse of the liner as product is withdrawn from the cavity of the collapsible liner. This method of collapse is in contrast to the deflation of the liner illustrated in FIG. 15, although it is to be understood that both modes of collapse are provided by the present invention.

Clauses Reciting Further Aspects of the Invention

Further aspects of the invention are recited in the following numbered Clauses. It will be appreciated that further features, disclosed elsewhere in this specification, may be incorporated into these Clauses.

Clause 1. A rigid cartridge comprising a rigid outer and a collapsible liner for containing a liquid or semi-liquid product wherein the cartridge has an opening adapted to receive a product withdrawing conduit, characterised in that the opening has a cross-section substantially identical to that of that product withdrawing conduit and elastomeric material on its inner surface such that a substantially airtight seal around the product withdrawing conduit and that when the product withdrawing conduit is removed from the opening, it is wiped substantially clean of any product on its exterior surface.

Clause 2. The rigid cartridge of clause 1, wherein the opening is in a necked portion of the cartridge and wherein the opening has an elastomeric ring gasket filled to the inner surface of the opening.

Clause 3. The rigid cartridge of clause 1 or 2, wherein the rigid outer is made of a compostable plastic material.

Clause 4. The rigid cartridge of clause 1 or 2, wherein the rigid outer is made of a recyclable plastics material having more than 95% purity.

Clause 5. The rigid cartridge of any of clauses 1 to 4, wherein the rigid cartridge contains a liquid or semi-liquid product.

Clause 6. The rigid cartridge of clause 5, wherein the liquid or semi-liquid product is a cosmetic product.

Clause 7. The rigid cartridge of any of clauses 1 to 6, wherein the material of the rigid outer comprises at least 95% of the total material of the rigid cartridge by weight.

Clause 8. The rigid cartridge of any of clauses 1 to 7, wherein the material of the rigid outer is compostable, and wherein optionally, the material of the collapsible liner and optionally the elastomeric material is also compostable.

Clause 9. The rigid cartridge of any of clauses 1 to 8, further comprising a sealing film or foil across the opening.

Clause 10. A product container comprising an outer sleeve into which a rigid cartridge as defined in any of clauses 1 to 9 may be inserted, said outer sleeve comprising a product withdrawing conduit and a manually operated pump wherein operation of the pump is arranged to be suitable to pump a liquid or semi-liquid product into the product withdrawing conduit and out through a product dispensing head.

Clause 11. A product container of clause 10, further comprising a rigid cartridge as defined in any of clauses 1 to 9.

Clause 12. A product container of clause 10 or 11, further comprising a bottom closure adapted to retain a rigid cartridge which has been inserted into the outer sleeve.

Clause 13. A product container of clause 10, 11 or 12, wherein the product withdrawing conduit comprises a portion which is substantially cylindrical and which is suitable for engaging with a substantially cylindrical opening in the rigid cartridge, and a spoked portion which is substantially conical and is suitable for piecing a foil or film.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A device for containing a liquid or semi-liquid cosmetic or pharmaceutical product, the device comprising:

a closure comprising a product withdrawing conduit;

a rigid container having a first means for engaging with the closure, thereby closing the container; and a cartridge enclosed within the rigid container, the cartridge having a second means for engaging with the closure, thereby forming a substantially airtight seal between the cartridge and the closure;

wherein the cartridge comprises a rigid outer enclosing a collapsible liner, the collapsible liner defining a cavity for containing the product, wherein the rigid outer comprises a material selected from a biodegradable material and a recyclable material;

wherein the product withdrawing conduit extends inside the cavity; and wherein the cartridge also comprises one or more further components for holding together the collapsible liner and the rigid outer, which is or are configured to restrict undesirable movement of the liner relative to the outer when the rigid container is engaged with and/or disengaged from the closure, wherein the liner and outer may still be deliberately decoupled from each other by a user for separate disposal, by means of removal or disengagement of the one or more further components; wherein the one or more further components comprise a ring, one or more clips, or a snap-off fastener, configured to engage with the rigid outer and to hold together the collapsible liner and the rigid outer.

2. The device of claim 1, wherein the rigid outer comprises the biodegradable material.

3. The device of claim 2, wherein the biodegradable material of the rigid outer comprises one or more of: polylactic acid; polyhydroxyalkanoate; a starch-based polymer; a cellulose-based polymer; a lignin-based polymer; a wood material; a material comprising fibers or particles of wood or other plant material embedded in a biodegradable resin; and a biodegradable fiber-reinforced thermoplastic composite.

4. The device of claim 1, wherein the rigid outer comprises the recyclable material.

5. The device of claim 4, wherein the recyclable material comprises one or more of: of high density polyethylene; polyethylene terephthalate; polyethylenefuranoate; polytrimethylene furanicarboxylate; polypropylene; glass; aluminum; and steel.

6. The device of claim 1, wherein the one or more further components are configured to restrict rotation of the collapsible liner relative to the rigid outer when the rigid container is engaged with and/or disengaged from the closure.

7. The device of claim 6, wherein the collapsible liner and rigid outer comprise engagement means, wherein the engagement means are configured to restrict undesirable movement of the liner relative to the outer when the rigid container is engaged with and/or disengaged from the closure.

8. The device of claim 7, wherein the engagement means comprise an annular collar comprised by the collapsible liner that is configured to engage with a complementary annular section of the rigid outer, or complementary screw threads, or a bayonet fitting, or a snap-fit arrangement, or a friction fit arrangement, or a magnetic fastener.

9. The device of claim 1, wherein the first means for engaging with the closure comprises one or more detents, or a screw thread, or a bayonet fitting, or a snap-fit arrangement, or a friction fit arrangement, or a magnetic fastener; and/or wherein the second means for engaging with the closure comprises one or more detents, or a screw thread, or a bayonet fitting, or a snap-fit arrangement, or a friction fit arrangement, or a magnetic fastener.

10. The device of claim 1, wherein the second means for engaging with the closure is provided on or as part of the collapsible liner.

11. The device of claim 10, wherein the engagement means comprise an annular collar comprised by the collapsible liner that is configured to engage with a complementary annular section of the rigid outer, or complementary screw threads, or a bayonet fitting, or a snap-fit arrangement, or a friction fit arrangement, or a magnetic fastener; and wherein the annular collar of the collapsible liner is disposed between a main body of the liner and the second means for engaging with the closure.

12. The device of claim 1, wherein the material of the rigid outer comprises at least 90% by weight of total material of the cartridge.

13. The device of claim 1, wherein a main body of the collapsible liner has a wall thickness of up to 0.5 mm; and/or wherein the collapsible liner comprises a material selected from a biodegradable material and a recyclable material.

14. The device of claim 13, wherein the collapsible liner comprises the recyclable material; and wherein the recyclable material of the collapsible liner is selected from polyethylene terephthalate (PET), polyethylenefuranoate (PEF); polytrimethylene furanicarboxylate (PTF), 10 polypropylene (PP), and combinations thereof.

15. The device of claim 1, wherein the product withdrawing conduit extends into the cavity by no more than 25% of a longest dimension of the collapsible liner, or wherein the product withdrawing conduit extends into the cavity by more than 50% of the longest dimension of the collapsible liner.

16. The device of claim 1, wherein the product withdrawing conduit comprises a substantially cylindrical portion and a spiked portion, the spiked portion being substantially conical and suitable for piecing a foil or a film.

17. The device of claim 1, wherein the closure comprises a pump; and wherein the pump is operable to pump the product from the cavity into the product withdrawing conduit and out of the device through a product dispensing head.

18. The device of claim 17, wherein the pump is a manually operated pump.

19. The device of claim 17, wherein the pump is an automatic pump.

20. The device of claim 1, wherein the device comprises the liquid or semi-liquid product.

21. The device of claim 20, wherein the product is a cosmetic product or a pharmaceutical product.

22. A method of making the device of claim 1, the method comprising:

providing the closure, the rigid container, and the cartridge; and attaching each of the rigid container and the cartridge to the closure.

23. A kit of parts for forming the device of claim 1, the kit comprising the closure of the device of claim 1, the rigid container and the cartridge of claim 1.

24. The The device of claim 1, wherein the rigid outer comprises the recyclable material;

and wherein the recyclable material is a recyclable polyester selected from polyethylene terephthalate (PET), polyethylenefuranoate (PEF); polytrimethylene furanicarboxylate (PTF), 10 polypropylene (PP), and combinations thereof.

* * * * *